US009938105B2

(12) United States Patent
Iwatsuki

(10) Patent No.: US 9,938,105 B2
(45) Date of Patent: Apr. 10, 2018

(54) MEDIUM PROCESSING DEVICE

(71) Applicant: Oki Electric Industry Co., Ltd., Tokyo (JP)

(72) Inventor: Kei Iwatsuki, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 364 days.

(21) Appl. No.: 14/376,769

(22) PCT Filed: Dec. 13, 2012

(86) PCT No.: PCT/JP2012/082395

§ 371 (c)(1),
(2) Date: Aug. 5, 2014

(87) PCT Pub. No.: WO2013/140682

PCT Pub. Date: Sep. 26, 2013

(65) Prior Publication Data

US 2015/0014469 A1 Jan. 15, 2015

(30) Foreign Application Priority Data

Mar. 21, 2012 (JP) ..... 2012-063270

(51) Int. Cl.
*G07F 7/04* (2006.01)
*B65H 23/02* (2006.01)
(Continued)

(52) U.S. Cl.
CPC ..... *B65H 23/0216* (2013.01); *B65H 29/006* (2013.01); *B65H 43/08* (2013.01);
(Continued)

(58) Field of Classification Search
CPC ..... G07D 11/009; G07D 11/0009; G07D 11/0006; G07D 2211/00; G07D 11/0012;
(Continued)

(56) References Cited

U.S. PATENT DOCUMENTS 6,164,585 A * 12/2000 Lutz ..... B65H 5/28 242/528
6,371,473 B1 * 4/2002 Saltsov ..... B65H 29/006 194/206
(Continued)

FOREIGN PATENT DOCUMENTS

CN 101180661 A 5/2008
CN 103186943 A 7/2013
(Continued)

OTHER PUBLICATIONS

Chinese Office Action with translation dated Apr. 5, 2016.
Japanese Office Action with translation dated May 1, 2015.

*Primary Examiner* — Jeffrey A Shapiro
(74) *Attorney, Agent, or Firm* — Rabin & Berdo, P.C.

(57) ABSTRACT

A medium processing device includes a drum; plural inner tapes; plural outer tapes; differing regions formed on a starting end portion that is an end at a drum side of at least one of the plural inner tapes or the plural outer tapes, and on a terminal end portion that is an inner reel side or an outer reel side of all of the inner tapes or all of the outer tapes; plural detecting unites that detect the physical property at a tape position of one of the inner tape or the outer tape that has a differing region formed on the starting end portion or the terminal end portion, the tape position being located between the drum and the inner and the outer reels; and a control unit that controls a rotation of the drum based upon the detection results of the plural detecting units.

7 Claims, 30 Drawing Sheets

(51) Int. Cl.
*B65H 29/00* (2006.01)
*B65H 43/08* (2006.01)
*G07D 11/00* (2006.01)

(52) U.S. Cl.
CPC ..... *B65H 2301/4144* (2013.01); *B65H 2301/41912* (2013.01); *B65H 2511/512* (2013.01); *B65H 2513/512* (2013.01); *B65H 2701/1912* (2013.01); *G07D 11/0003* (2013.01); *G07D 11/003* (2013.01); *G07D 11/0024* (2013.01); *G07D 11/0033* (2013.01)

(58) Field of Classification Search
CPC ..... G07D 11/003; G07D 11/0003; G07D 11/0024; G07D 11/0033; G07D 11/0081; G07D 11/0084; G07D 11/0087; G07D 2207/00; G07F 7/04; B65H 29/006; B65H 2301/41912; B65H 2701/1912; B65H 75/30; B65H 59/00; B65H 23/042; B65H 2403/72; B65H 2553/00; B65H 29/00; B65H 5/00; B65H 5/02; B65H 5/18; B65H 5/028; B65H 5/06; B65H 5/224; B65H 5/226; B65H 85/00; B65H 2553/80; B65H 7/00
USPC ..... 194/206, 207; 209/534; 235/379; 242/528, 396, 396.1, 396.2, 396.4; 271/3.14, 216, 176, 3.16, 3.21, 258.01, 271/259, 275
See application file for complete search history.

(56) References Cited

U.S. PATENT DOCUMENTS 7,654,485 B2 * 2/2010 Rossel ..... B65H 5/28 242/528
8,186,673 B2 * 5/2012 Michels ..... B65H 29/006 242/528
8,297,547 B2 * 10/2012 Michels ..... B65H 29/006 242/528
8,302,757 B1 * 11/2012 Angus ..... B65H 5/023 194/206
8,413,919 B2 * 4/2013 Michels ..... B65H 29/006 242/528
8,725,297 B2 * 5/2014 Oishi ..... B65H 29/006 194/203
8,967,522 B2 * 3/2015 Ebinuma ..... B65H 29/006 242/528
9,342,944 B2 * 5/2016 Amo ..... B65H 29/006
2002/0113160 A1 * 8/2002 Niioka ..... B65H 29/006 242/528
2003/0116400 A1 * 6/2003 Saltsov ..... B65H 29/006 194/207
2003/0155704 A1 * 8/2003 Polidoro ..... B65H 29/006 271/216
2006/0214350 A1 * 9/2006 Saltsov ..... B65H 29/006 271/3.01
2006/0225986 A1 10/2006 Oishi et al.
2007/0221776 A1 * 9/2007 Rossel ..... B65H 5/28 242/528
2010/0072220 A1 * 3/2010 Michels ..... B65H 29/006 221/71
2010/0100245 A1 * 4/2010 Oishi ..... B65H 29/006 700/275
2011/0017766 A1 * 1/2011 Michels ..... B65H 29/006 221/71
2011/0073611 A1 * 3/2011 Tosaka ..... B65H 29/006 221/71
2012/0104015 A1 * 5/2012 Ebinuma ..... B65H 29/006 221/13
2013/0081922 A1 * 4/2013 Amo ..... B65H 29/006 194/206

FOREIGN PATENT DOCUMENTS

JP 2005-505068 A 2/2005
JP 2006-290513 A 10/2006
JP 2010-006494 A 1/2010
WO WO-2009/157264 A1 12/2009
WO WO 2011-036782 A1 3/2011

* cited by examiner

FIG.13

TBL1

| STATUS | TAPE SENSOR 35A (OUTER TAPE 130A) | TAPE SENSOR 45A (INNER TAPE 40A) | TAPE SENSOR 135B (OUTER TAPE 130B) | TAPE SENSOR 45B (INNER TAPE 40B) |
|---|---|---|---|---|
| MIDDLE PORTION DETERMINED | ○ | ○ | ○ | ○ |
| UNDETERMINED | ● | ○ | ○ | ○ |
| TERMINAL END PORTION DETERMINED | * | ● | * | * |
| | * | * | ● | * |
| | * | * | * | ● |

○ : "BRIGHT" LEVEL
● : "DARK" LEVEL
* : "BRIGHT" LEVEL OR "DARK" LEVEL

MEDIUM PROCESSING DEVICE

TECHNICAL FIELD

The present invention relates to a medium processing device, and is well adaptable to an automated teller machine (ATM) that allows a user to input a medium, such as a bill, for making a desired transaction.

BACKGROUND ART

Conventionally, an automated teller machine used in a financial institution is configured to allow a customer to charge cash such as bills or coins or allow a customer to extract cash, depending upon a transaction with the customer.

An automated teller machine including a bill dispensing port for delivering or receiving a bill to or from a customer, a discrimination unit that discriminates a denomination and authentication of the charged bill, a temporary holding unit that temporarily holds the charged bill, and a bill cassette that stores bills by each denomination has been proposed.

When a customer charges a bill into the bill dispensing port during a deposit transaction, the automated teller machine described above discriminates the charged bill, and holds the bill discriminated as an authentic bill in the temporary holding unit, but returns a bill discriminated that this bill should not to be used for the transaction to the bill dispensing port, and returns this bill to the customer. After the customer confirms the deposited amount, the automated teller machine then discriminates again the denomination of the bill held in the temporary holding unit, and stores each bill into each bill cassette according to the discriminated denomination.

The proposed temporary holding units include the one having a rotating cylindrical drum and two long tapes, wherein one end of each of the tapes is fixed on a peripheral side face of the drum as being overlapped with each other (e.g., see FIGS. 1 and 2 in Japanese Patent Application Laid-Open (JP-A) No. 2010-6494).

For example, a conventional temporary holding unit 315 includes a cylindrical drum 23 and one type of a tape running system 27A as illustrated in FIGS. 19A and 19B. The tape running system 27A includes an outer tape 30A and an inner tape 40A, which are made of a transparent resin material, and an outer reel 31A and an inner reel 41A around which the outer tape 30A and the inner tape 40A are wound respectively. Terminal ends of the outer tape 30A and the inner tape 40A are fixed respectively to the outer reel 31A and the inner reel 41A, and starting ends are fixed on the peripheral side face of the drum 23 as being overlapped with each other.

With this configuration, the temporary holding unit 315 can wind a bill BL around the peripheral side face of the drum 23 together with the outer tape 30A and the inner tape 40A by rotating the drum 23 in a winding direction R1 with the bill BL sandwiched between the outer tape 30A and the inner tape 40A as a winding operation. The temporary holding unit 315 can also sequentially discharge the bill BL by rotating the drum 23 in a rewinding direction R2 by winding the outer tape 30A and the inner tape 40A around the outer reel 31A and the inner reel 41A respectively as a rewinding operation.

As illustrated in FIG. 20, a light-shielding region SA that shields light is formed on the starting end (close to the drum) of the outer tape 30A and the terminal end (close to the reel) of the inner tape 40A. The temporary holding unit 315 generates a light-receiving signal with a "bright" level corresponding to a transparent portion or a light-receiving signal with a "dark" level corresponding to the light-shielding region SA from a tape sensor 35A and a tape sensor 45A that emit detection light to the temporary holding unit 315 and receive the detection light.

When performing the winding operation, a control unit 321 of the temporary holding unit 315 executes a winding procedure RT7 illustrated in FIG. 21. The control unit 321 proceeds to step SP61 to rotate the drum 23 in the winding direction R1, and then, proceeds to next step SP62 to acquire the light-receiving signal from the tape sensor 45A.

Next, the control unit 321 proceeds to step SP63. When the light-receiving signal has the "bright" level, the control unit 321 returns again to step SP61. When the light-receiving signal has the "dark" level, the control unit 321 proceeds to next step SP64 to stop the rotation of the drum 23, and then, proceeds to step SP65 to end the winding procedure RT7. Thus, the temporary holding unit 315 can stop the drum 23 before each tape is completely wound around each reel, thereby being capable of preventing damage at the outer tape 30A and the inner tape 40A caused by excessive tensile force applied to these tapes.

SUMMARY OF INVENTION

Technical Problem

As the temporary holding unit, a temporary holding unit 415 is considered in order to wind a bill BL around the drum 23 more stably. The temporary holding unit 415 is configured by further including a tape running system 427B corresponding to the tape running system 27A as illustrated in FIGS. 22A and 22B corresponding to FIGS. 19A and 19B.

In this configuration, the temporary holding unit 415 simultaneously winds four tapes in the two systems around the cylindrical drum 23. Therefore, when a leading portion or a terminal portion of one tape is detected, leading ends or terminal ends of the other tapes are considered to be detected.

The tape running system 427B further includes an outer tape 430B and an inner tape 440B, which have no light-shielding region SA, in addition to an outer reel 31B similar to the outer reel 31A and an inner reel 41B similar to the inner reel 41A, and the tape running system 427B does not have a tape sensor, as illustrated in FIG. 23 corresponding to FIG. 20.

However, when a bill BL having a wrinkle or a crease is wound around the drum 23 in the temporary holding unit 415, an apparent outer diameter (hereinafter referred to as a winding diameter) including the bill BL wound around the peripheral side face of the drum 23 increases more than in a case in which a flat bill BL is wound, and becomes a so-called expanded state.

In particular, when a bill BL has a wrinkle or crease only on one side in the longitudinal direction in the temporary holding unit 415, the winding diameter (expansion) of the drum becomes inclined as illustrated in FIGS. 24A and 24B. Therefore, the length of the tape wound around the drum differs for each tape running system.

When the winding diameter of the drum 23 in the tape running system 427B side is larger than the winding diameter of the drum 23 in the tape running system 27A side, there is a possibility that the outer tape 430B and the inner tape 440B might reach their terminal ends before the tape sensor 45A detects the light-shielding region SA on the terminal end of the inner tape 40A; in other words, there is a possibility that the outer tape 440A and the inner tape 440B reaching their terminal ends cannot be detected.

In this case, the temporary holding unit 415 has the problem that damage is generated at these tapes due to excessive tensile force applied to the outer tape 440A and the inner tape 440B, and hence, the movement of these tapes has to be stopped.

Solution to Problem

The present invention is accomplished in view of the above circumstances, and aims to provide a medium processing device that can stably operate.

In order to solve the foregoing problems, a medium processing device according to the present invention includes a drum that is cylindrical and rotates about a center axis; plural inner tapes, each tape of which has a predetermined length in a longitudinal direction, is drawn from an inner reel around which the tape is wound in advance, and is wound around a peripheral side face of the drum at two or more different portions of the drum in an axial direction along the center axis; plural outer tapes, each tape of which has a predetermined length in a longitudinal direction, is drawn from an outer reel around which the tape is wound in advance, and is wound around a peripheral side face of the drum together with the inner tape and a sheet-shaped medium with the medium being sandwiched between the inner tape and the outer tape; differing regions formed respectively on a starting end portion that is an end at a drum side of at least one of the plural inner tapes or the plural outer tapes, and on a terminal end portion that is an inner reel side or an outer reel side of all of the inner tapes or all of the outer tapes, the differing regions having a physical property different from the other regions; plural detecting units that detect the physical property at a tape position of one of the inner tape or the outer tape that has the differing region formed on the starting end portion or the terminal end portion, the tape position being located between the drum and the inner and the outer reels; and a control unit that controls a rotation of the drum based upon the detection results of the plural detecting units.

According to this configuration, even when the inner tape or the outer tape, in either one of the tape running systems using a combination of one inner tape and one outer tape that sandwich a medium, reaches its terminal end portion during a winding operation, the state in which the tape reaches its terminal end portion can reliably be detected by the detecting units that are provided at the respective tape running systems and that detect the differing region. Accordingly, the medium processing device can stop the rotation of the drum, and can prevent damage from occurring at the inner tape and the outer tape.

Advantageous Effects Of Invention

According to the present invention, even when the inner tape or the outer tape in either one of the tape running systems using a combination of one inner tape and one outer tape that sandwich a medium reaches its terminal end portion during a winding operation, the state in which the tape reaches its terminal end portion can reliably be detected by the detecting units that are provided at the respective tape running systems and that detect the differing region. Thus, the medium processing device can stop the rotation of the drum, and can prevent damage from occurring at the inner tape and the outer tape. Accordingly, the present invention can realize a medium processing device that can stably operate.

BRIEF DESCRIPTION OF DRAWINGS

FIG. 13 is a schematic diagram illustrating a relationship between a detection result of a tape sensor and a status.

DESCRIPTION OF EMBODIMENTS

Embodiments for embodying the present invention (hereinafter referred to as embodiments) will be described below with reference to the drawings.

[1. First Embodiment]

[1-1. Overall Configuration of Automated Teller Machine]

Figure 1:
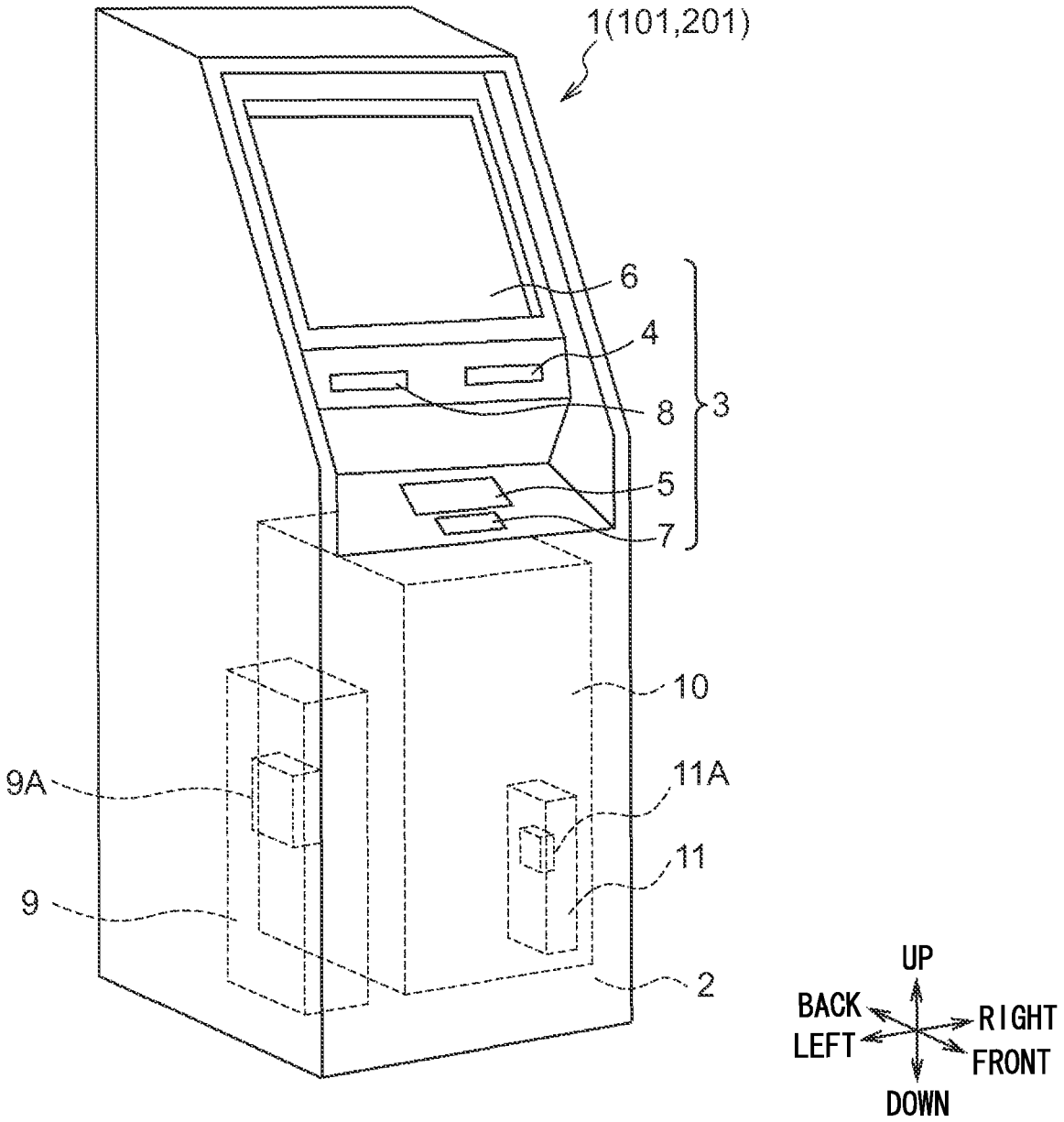
FIG. 1 is a schematic diagram illustrating a configuration of an automated teller machine.

An automated teller machine 1 mainly includes a box-like housing 2 as illustrated in FIG. 1 that illustrates an outer appearance thereof. The automated teller machine 1 is placed in a financial institution, for example, for allowing a customer to make a transaction for cash including a deposit transaction and a withdrawal transaction.

The housing 2 has a shape in which a portion into which a customer standing in front of the housing 2 is easy to charge a bill BL or easy to operate a touch panel, i.e., a portion from an upper part of a front surface to a top surface, is obliquely cut off. A customer service unit 3 is provided at this portion.

The customer service unit 3 is configured to directly send or receive cash or a passbook to or from a customer, and to report information about a transaction or accept an operation instruction. The customer service unit 3 includes a card slot 4, a bill dispensing port 5, an operation display unit 6, a numeric keypad 7, and a receipt issuing port 8.

The card slot 4 is the portion into which various cards such as a cash card are inserted or from which various cards are discharged. A card processing unit (not illustrated) that reads an account number magnetically recorded on various cards is provided at the back of the card slot 4.

The bill dispensing port 5 is the portion into which a bill BL that is deposited by a customer is charged, and from which a bill BL that is to be delivered to the customer is discharged. The bill dispensing port 5 is opened or closed by driving a shutter. A bill BL is made of a rectangular paper, for example.

The operation display unit 6 includes an LCD (Liquid Crystal Display) displaying an operation screen for a transaction, and a touch panel for selecting a type of a transaction and inputting a personal identification number or a transaction amount by a customer. The LCD and the touch panel are integrally formed.

The numeric keypad 7 is a physical key accepting an input of numerals of "0" to "9", and is used for an input operation of a personal identification number or a transaction amount.

The receipt issuing port 8 issues a receipt on which a transaction detail is printed upon the end of the transaction. A receipt processing unit (not illustrated) for printing a transaction detail on a receipt is provided at the back of the receipt issuing port 8.

In the description below, the side of the automated teller machine 1 that the customer faces is defined as a front side, the side reverse to the front side is defined as a back side, the left and right viewed from the customer facing the front side are defined as a left side and a right side respectively, and upper and lower sides are also defined.

A main control unit 9 generally controlling the automated teller machine 1 and a bill dispenser 10 performing various processing involved with a bill BL are provided in the housing 2.

The main control unit 9 mainly includes a CPU (Central Processing Unit), and is configured to execute various processing such as a deposit transaction and withdrawal transaction by reading a predetermined program from ROM or flash memory, not illustrated, and executing this program.

The main control unit 9 includes inside a storage unit 9A provided with RAM (Random Access Memory), a hard disk drive, and flash memory, and is configured to record various information pieces into this storage unit 9A.

The housing 2 is provided with a door, which can be opened and closed, on some side faces including a front face and a back face. Specifically, the housing 2 protects the bill BL stored in the bill dispenser 10 by closing each door illustrated in FIG. 1 during the transaction operation for performing a transaction for cash with a customer. On the other hand, during a maintenance operation made by a worker, each door is opened, if necessary, to allow the worker to easily do his/her work on each component in the housing 2.

Figure 2:
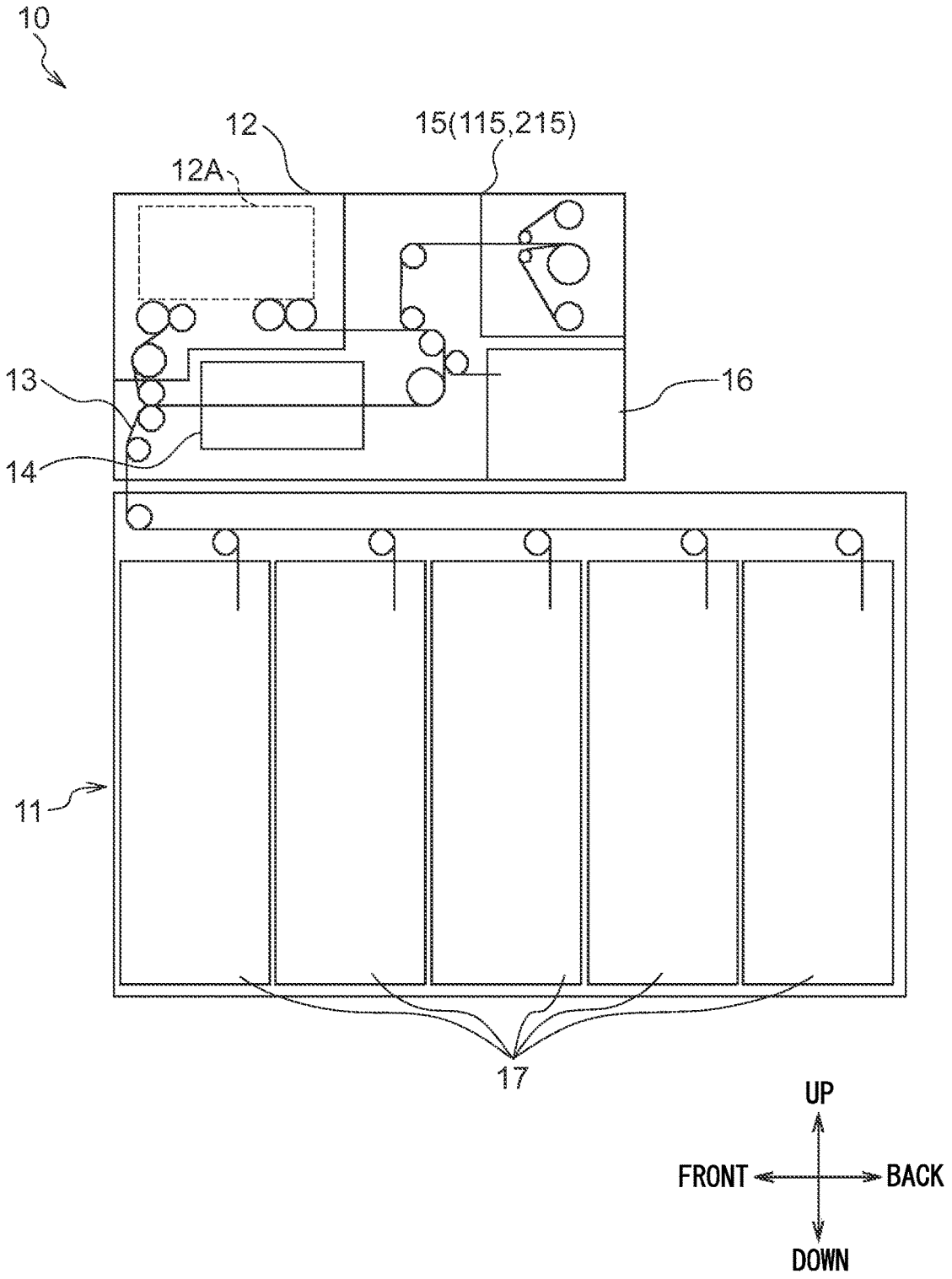
FIG. 2 is a schematic side view illustrating a configuration of a bill dispenser.

As illustrated by a side view in FIG. 2, the bill dispenser 10 is configured by combining plural components performing various transactions involved with a bill BL. Each component in the bill dispenser 10 is controlled by a bill control unit 11.

The bill control unit 11 mainly includes a CPU not illustrated as in the main control unit 9. The bill control unit 11 is configured to execute various processing, such as processing of determining a destination to which the bill BL is sent, by reading a predetermined program from ROM or flash memory, not illustrated, and executing this program.

The bill control unit 11 includes inside a storage unit 11A (FIG. 1) provided with RAM and flash memory, and is configured to record various information pieces into this storage unit 11A.

In a case in which a customer makes a deposit transaction for depositing a bill BL, for example, the bill control unit 11 accepts a predetermined operation input through the operation display unit 6, and then, opens a shutter of the bill dispensing port 5 to allow the customer to input a bill BL into a bill dispensing unit 12.

After the bill BL is put into a container 12A, the bill dispensing unit 12 closes the shutter of the bill dispensing port 5, extracts the bill BL one by one from the container 12A, and conveys the bill BL to a conveyance unit 13. The conveyance unit 13 conveys the bill BL formed into a rectangular paper sheet along a short-side direction to a discriminating unit 14.

The discriminating unit 14 discriminates a denomination, authentication, and an extent of damage of the bill BL by using an optical element or a magnetic detection element, while conveying the bill BL inside. The discriminating unit 14 transmits the discrimination result to the bill control unit 11. The bill control unit 11 decides the destination of the bill BL based upon the acquired discrimination result.

The conveyance unit 13 conveys the bill BL, which is discriminated as an authentic bill in the discriminating unit 14, to the temporary holding unit 15 to temporarily hold this bill, while conveys a reject bill discriminated as a bill that should not be used for a transaction to the bill dispensing unit 12, and returns this bill to the customer.

Thereafter, the bill control unit 11 allows the customer to confirm a deposit amount through the operation display unit 6, causes the conveyance unit 13 to convey the bill BL, which is temporarily held in the temporary holding unit 15, to the discriminating unit 14 to discriminate the denomination and the extent of damage, and acquires the discrimination result.

In a case in which the extent of the damage is great, the bill control unit 11 determines that this bill BL should not be reused, and causes the conveyance unit 13 to convey this bill BL to a reject cassette 16 to store this bill. In a case in which the extent of the damage is small, the bill control unit 11 causes the conveyance unit 13 to convey this bill as the bill BL that should be reused, whereby this bill is stored in a bill cassette 17 according to the denomination.

[1-2. Configuration of Temporary Holding Unit]

Figure 3A:
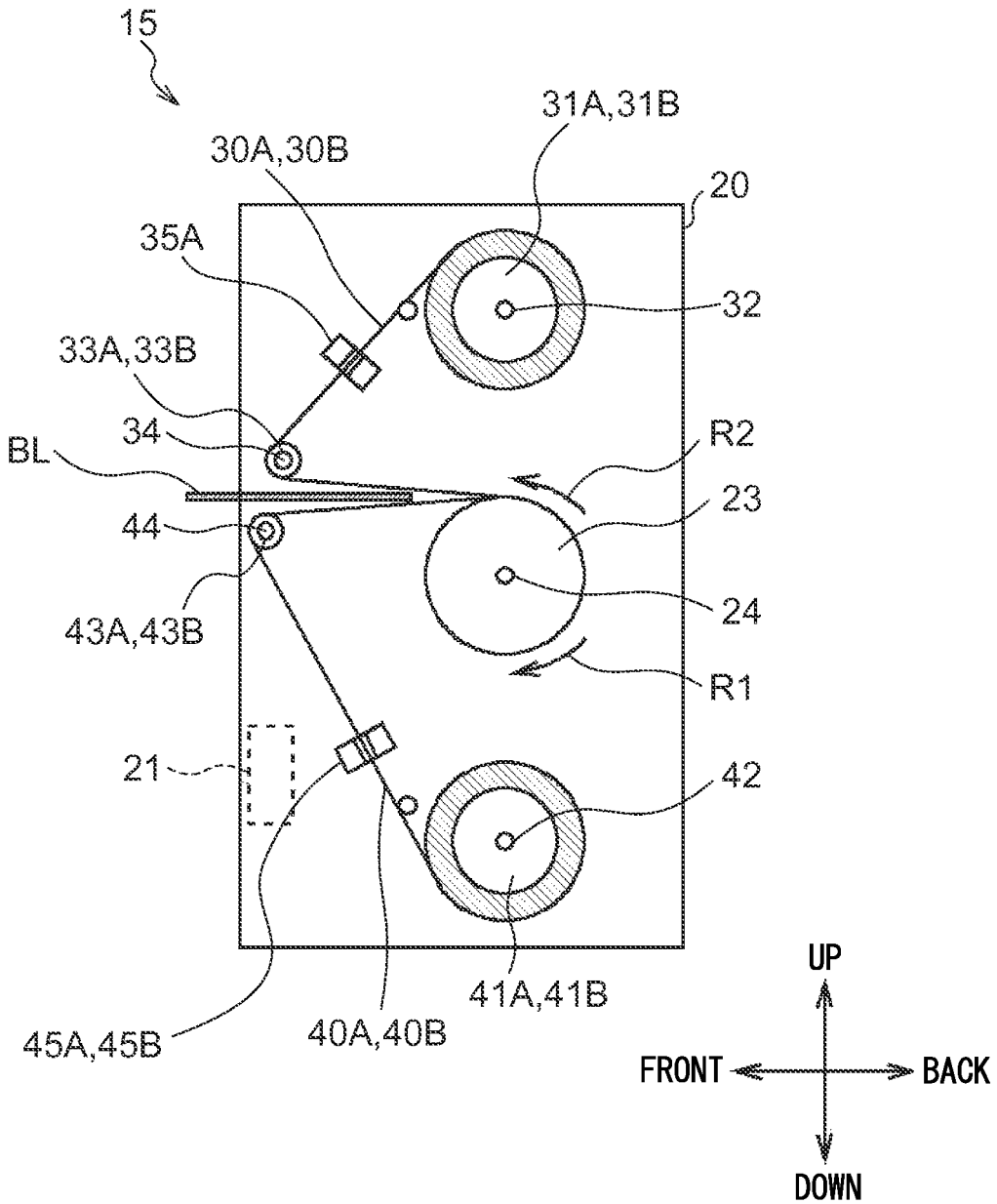
FIG. 3A is a right side view illustrating a configuration of a temporary holding unit according to a first embodiment.

The temporary holding unit 15 has components mounted on a frame 20 as illustrated in FIG. 3A.

Figure 3B:
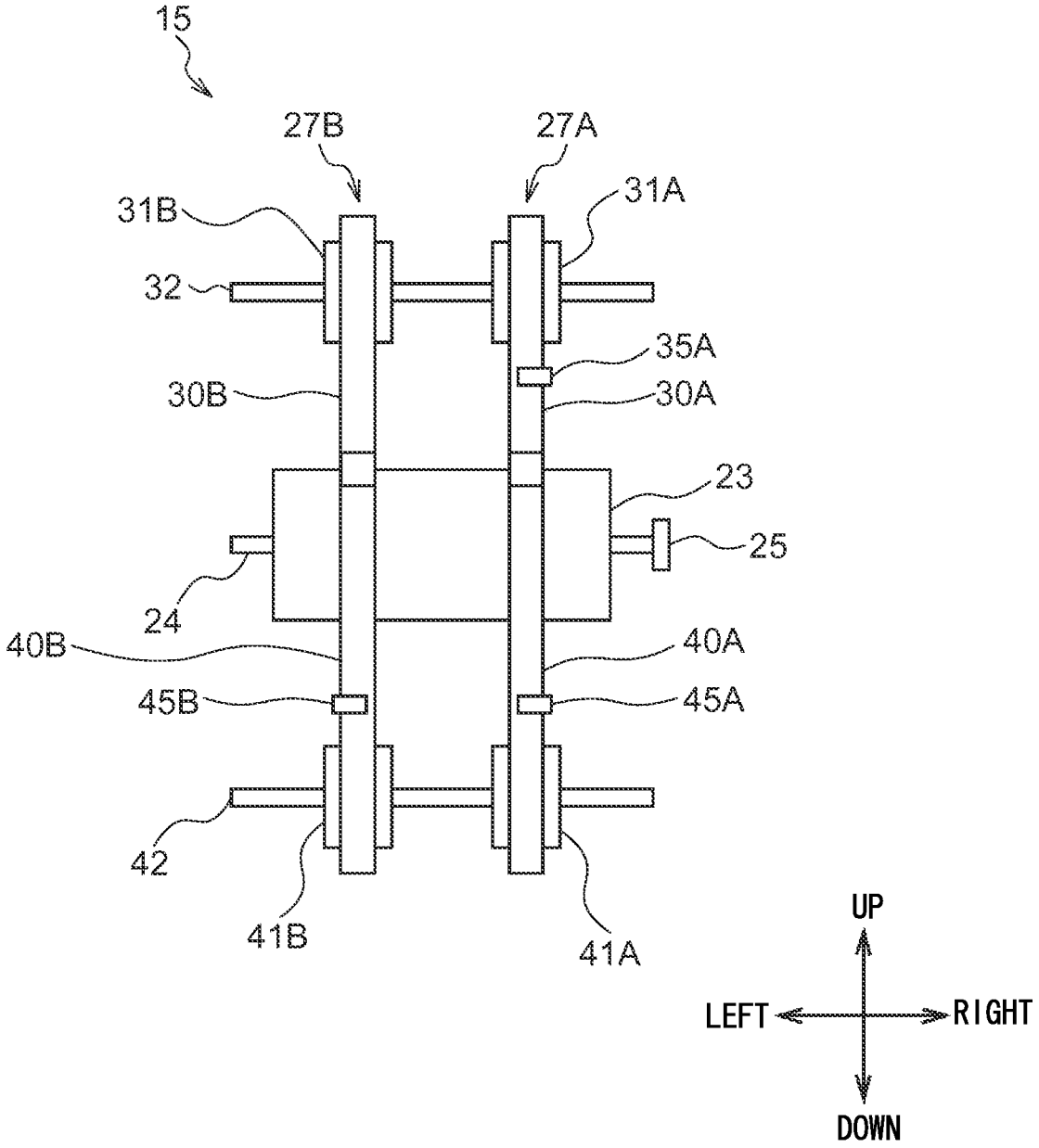
FIG. 3B is a back view illustrating the configuration of the temporary holding unit according to the first embodiment.

FIGS. 3A and 3B schematically illustrate a right side view and a back side view of the temporary holding unit 15, and these figures do not illustrate some components including a motor and a gear for the sake of convenience of the description.

The temporary holding unit 15 is configured to be generally controlled by a control unit 21. Like the main control unit 9 and the bill control unit 11 (FIG. 1), the control unit 21 mainly includes a CPU not illustrated, and is configured to perform various processing, such as control for a rotation of a drum for running a tape, by reading a predetermined program from ROM or flash memory, not illustrated, and executing this program, in cooperation with the bill control unit 11.

The control unit 21 also includes inside a storage unit having RAM and flash memory, and is configured to record various information pieces into this storage unit.

As illustrated in FIGS. 3A and 3B, a cylindrical drum 23 is provided in the vicinity of a center in the frame 20 of the temporary holding unit 15. The drum 23 is mounted to be capable of rotating in a winding direction R1 or in a rewinding direction R2 about a rotation axis 24 along a left-right direction, and to receive driving force from a motor, not illustrated, based upon the control of the control unit 21.

A drum rotation detecting unit 25 detects a rotating state of the drum 23, such as a rotating direction or a speed, and transmits the rotating state to the control unit 21 in the form of a rotation signal, whereby the last rotating direction is recorded in the control unit 21.

Tape running systems 27A and 27B, which have almost the same configuration except for some parts, are provided in the temporary holding unit 15. Each of the running systems 27A and 27B is provided at each of the left side and the right side. For the sake of convenience of description, the right tape running system 27A will mainly be described below.

The right tape running system 27A is configured to run two tapes that are an outer tape 30A and an inner tape 40A.

The outer tape 30A and the inner tape 40A are both formed into a thin film by using a resin material having high light permeability. Both of the outer tape 30A and the inner tape 40A have lengths in the longitudinal direction of, for example, 30 [m], which are sufficiently long, and lengths in the widthwise direction (i.e., the tape width) of, for example, 20 [mm], which are sufficiently shorter than the long sides of the bill BL.

An outer reel 31A is formed like a bobbin, and is mounted above the drum 23 so as to rotate about a rotation axis 32 parallel to the rotation axis 24 of the drum 23. The outer tape 30A is wound around the outer reel 31A with one end of the outer tape 30A fixed onto a peripheral side face of the outer reel 31A.

A pulley 33A is mounted in front of the drum 23. The pulley 33A is formed into a columnar shape, and inserted into a shaft 34 parallel to the rotation axis 24 of the drum 23 to be capable of freely rotating about the shaft 34.

The leading end of the outer tape 30A wound around the outer reel 31A is drawn frontward and downward from the outermost periphery of the outer reel 31A, wound around the pulley 33A to be folded backward, and then, fixed onto the peripheral side face of the drum 23.

The outer reel 31A is biased in a direction of rewinding the outer tape 30A by a torque limiter, not illustrated, to always apply predetermined tensile force to the outer tape 30A.

An inner reel 41A is formed like a bobbin as is similar to the outer reel 31A, and is mounted below the outer reel 31A, i.e., below the drum 23, so as to rotate about a rotation axis 42 parallel to the rotation axis 24 of the drum 23. The inner tape 40A is wound around the inner reel 41A with one end of the inner tape 40A fixed onto a peripheral side face of the inner reel 41A.

The winding direction of the inner tape 40A around the inner reel 41A is reverse to the winding direction of the outer tape 30A around the outer reel 31A.

A pulley 43A is mounted in front of the inner reel 41A and below the pulley 33A. The pulley 43A is formed into a columnar shape as is similar to the pulley 33A, and inserted into a shaft 44 parallel to the rotation axis 24 of the drum 23 to be capable of freely rotating about the shaft 44.

The leading end of the inner tape 40A wound around the inner reel 41A is drawn frontward and upward from the outermost periphery of the inner reel 41A, wound around the pulley 43A to be folded backward, and then, fixed onto the peripheral side face of the drum 23.

Like the outer reel 31A, the inner reel 41A is biased in a direction of rewinding the inner tape 40A by a torque limiter, not illustrated, to always apply predetermined tensile force to the inner tape 40A.

The left tape running system 27B includes an outer tape 30B, an outer reel 31B, a pulley 33B, an inner tape 40B, an inner reel 41B, and a pulley 43B, those of which are similar to the outer tape 30A, the outer reel 31A, the pulley 33A, the inner tape 40A, the inner reel 41A, and the pulley 43A of the tape running system 27A.

With the configuration described above, when the drum 23 is rotated in the winding direction R1, the temporary holding unit 15 winds the inner tape 40A and the outer tape 30A being overlapped with each other and the inner tape 40B and the outer tape 30B being overlapped with each other around the peripheral side face of the drum 23.

When the bill BL is sandwiched between the inner tapes 40A and 40B and the outer tapes 30A and 30B, the temporary holding unit 15 can wind the bill BL around the peripheral side face of the drum 23 together with the inner tapes 40A and 40B and the outer tapes 30A and 30B.

As described above, the temporary holding unit 15 can wind the bill BL around the peripheral side face of the drum 23 by running four tapes (the outer tapes 30A and 30B and the inner tapes 40A and 40B).

The tape running system 27A is also provided with a tape sensor 35A serving as a detecting unit at a portion of the outer tape 30A between the outer reel 31A and the pulley 33A, i.e., at a position (hereinafter referred to as a tape position) closest to the outermost portion of the outer tape 30A wound around the outer reel 31A.

In the tape sensor 35A, a light-emitting portion that emits detection light with a predetermined wavelength and a light-receiving portion that receives the detection light face each other such that the light-emitting portion and the light-receiving portion sandwiches both faces of the outer tape 30A. The tape sensor 35A emits detection light from the light-emitting portion, receives the detection light passing through the outer tape 30A, generates a light-receiving signal according to the brightness of the received light, and transmits this signal to the control unit 21.

Specifically, the tape sensor 35A generates a light-receiving signal according to a ratio of detection light passing through the outer tape 30A at the tape position (i.e., the irradiation portion of the detection light) of the outer tape 30A, and transmits this signal to the control unit 21.

If the light-receiving signal acquired from the tape sensor 35A is equal to or more than a value a predetermined threshold value, the control unit 21 determines that the signal has a "bright" level, and if the light-receiving signal is a value less than the threshold value, the control unit 21 determines that the signal has a "dark" level. Specifically, the determination result obtained by the control unit 21 is a value which is obtained by binarizing light transmittance of the outer tape 30A located at the tape sensor 35A at this time into the "bright" level or the "dark" level.

The tape running system 27A is also provided with a tape sensor 45A, having a configuration similar to the configuration of the tape sensor 35A, at a position of the inner tape 40A passing between the inner reel 41A and the pulley 43A, i.e., at a position which corresponds to a portion closest to the outermost portion of the inner tape 40A wound around the inner reel 41A.

The tape running system 27B is provided with a tape sensor 45B corresponding to the inner tape 40B, but not provided with a tape sensor corresponding to the outer tape 30B.

As described above, in the temporary holding unit 15, the tape sensor 35A is provided only at the tape running system 27A for the outer tape 30 (30A and 30B), and the tape sensors 45A and 45B are provided respectively at the tape running systems 27A and 27B for the inner tape 40 (40A and 40B).

Figure 4:
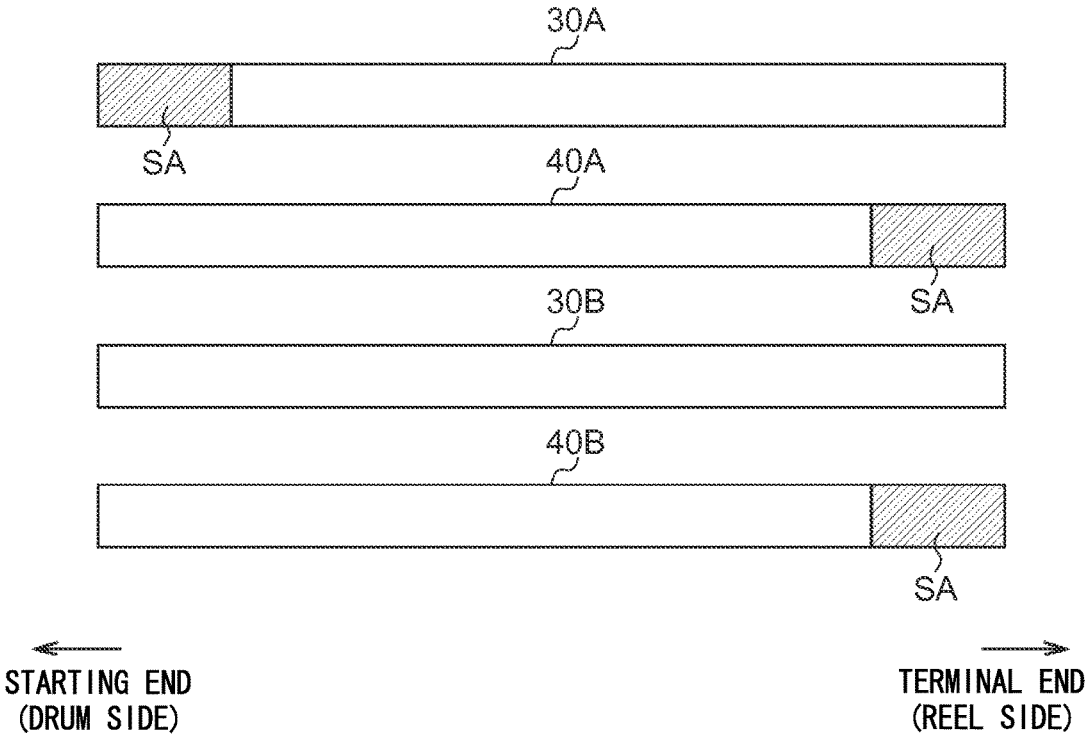
FIG. 4 is a schematic side view illustrating a configuration of a tape according to the first embodiment.

As illustrated in FIG. 4, the outer tape 30A is formed with a light-shielding region SA that shields the detection light from the tape sensor 35A at a portion of a starting end (hereinafter referred to as a starting end portion) fixed to the drum 23, as in the outer tape 30A in the conventional temporary holding unit 415.

Accordingly, the outer tape 30A transmits the detection light from the tape sensor 35A at a transparent portion where the light-shielding region SA is not formed, and shields the detection light in the light-shielding region SA.

Specifically, in a case in which the tape position of the outer tape 30A is a middle portion (a portion that is neither the starting end portion nor a terminal end portion) or the terminal end portion, the tape sensor 35A increases the level of the light-receiving signal, since the detection light passes through this middle portion. In a case in which the tape position is the starting end portion, the tape sensor 35A decreases the level of the light-receiving signal, since the detection light is shielded by the light-shielding region SA.

The threshold value, which is to be compared to the light-receiving signal by the control unit 21, is appropriately set to specify the signal level reduced by the light-shielding region SA as the "dark" level and the signal level equal to or higher than the reduced signal level as the "bright" level.

The inner tape 40A is formed with a light-shielding region SA at a portion of a terminal end (hereinafter referred to as a terminal end portion) fixed to the inner reel 41A, as same as the inner tape 40A in the conventional temporary holding unit 415.

Therefore, in a case in which the tape position is a starting end portion or a middle portion of the inner tape 40A, the tape sensor 45A increases the level of the light-receiving signal, since the detection light passes through the starting end portion or the middle portion.

In a case in which the tape position is the terminal end portion, the tape sensor 45A decreases the level of the light-receiving signal, since the detection light is shielded by the light-shielding region SA.

On the other hand, differently from the conventional inner tape 440B, in the inner tape 40B of the tape running system 27B, the light-shielding region SA is formed at its terminal end, like the inner tape 40A. In the outer tape 30B, a light-shielding region SA is not formed at any positions, like the conventional outer tape 430B.

Figure 22A:
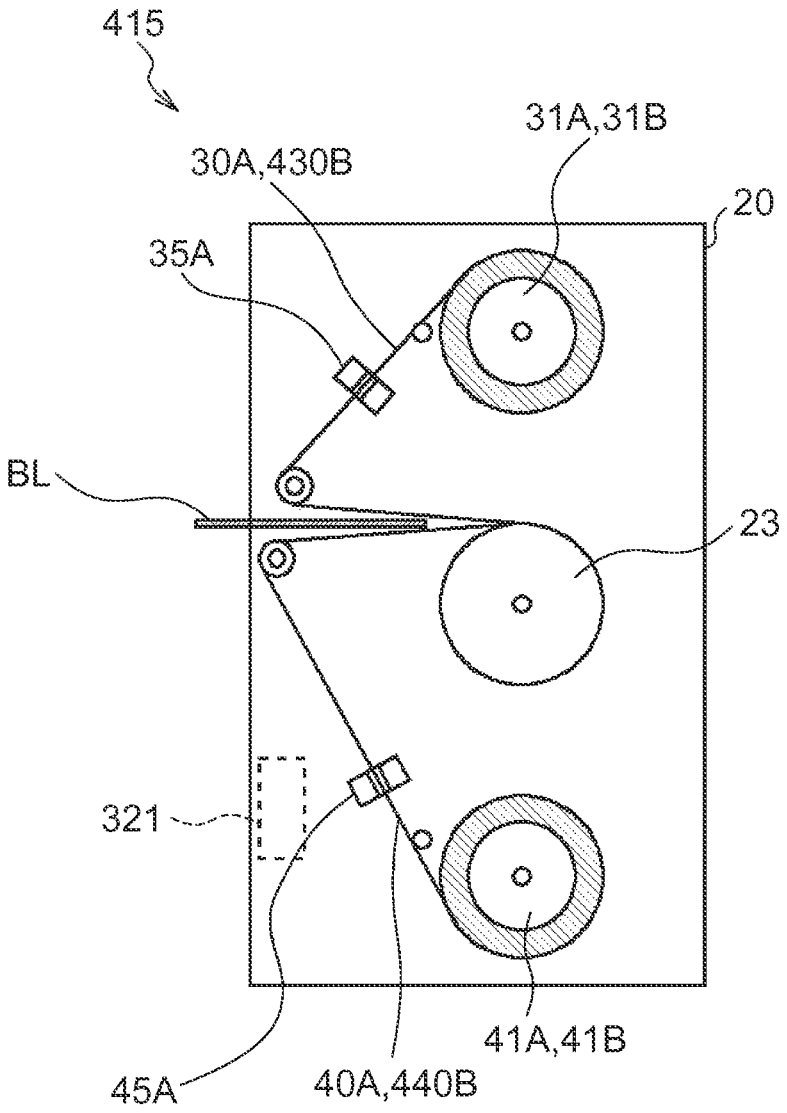
FIG. 22A is a right side view illustrating a configuration (2) of the conventional temporary holding unit.
Figure 22B:
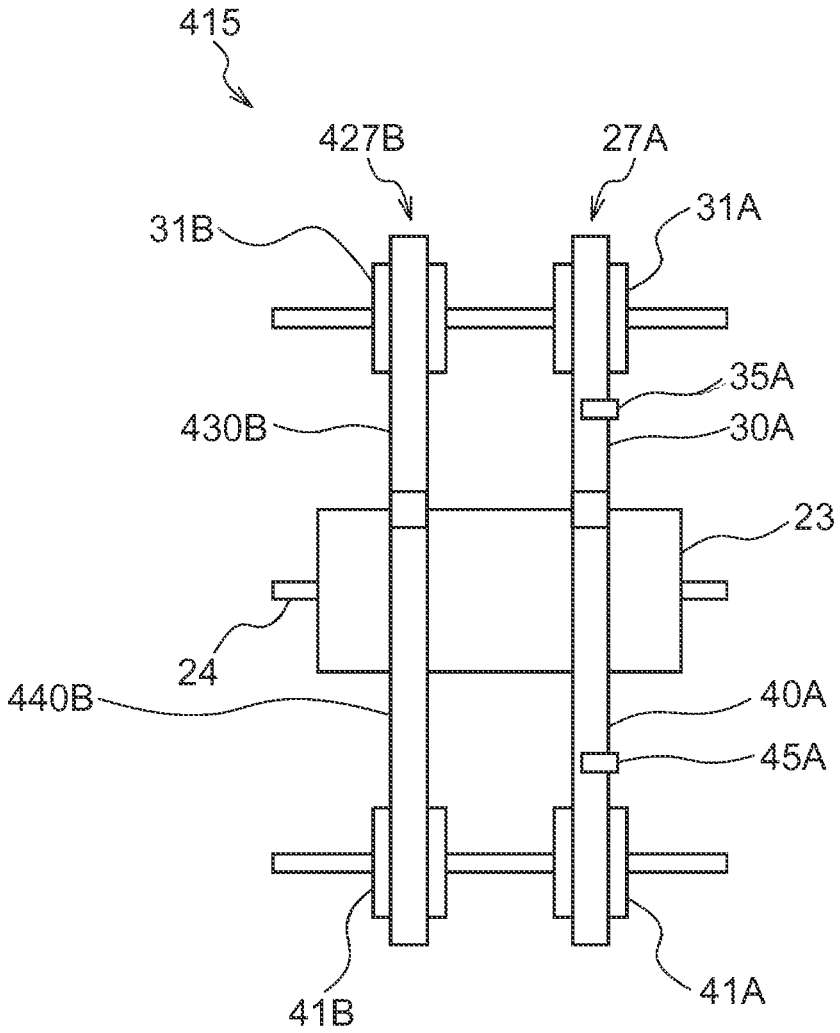
FIG. 22B is a back view illustrating the configuration (2) of the conventional temporary holding unit.
Figure 23:
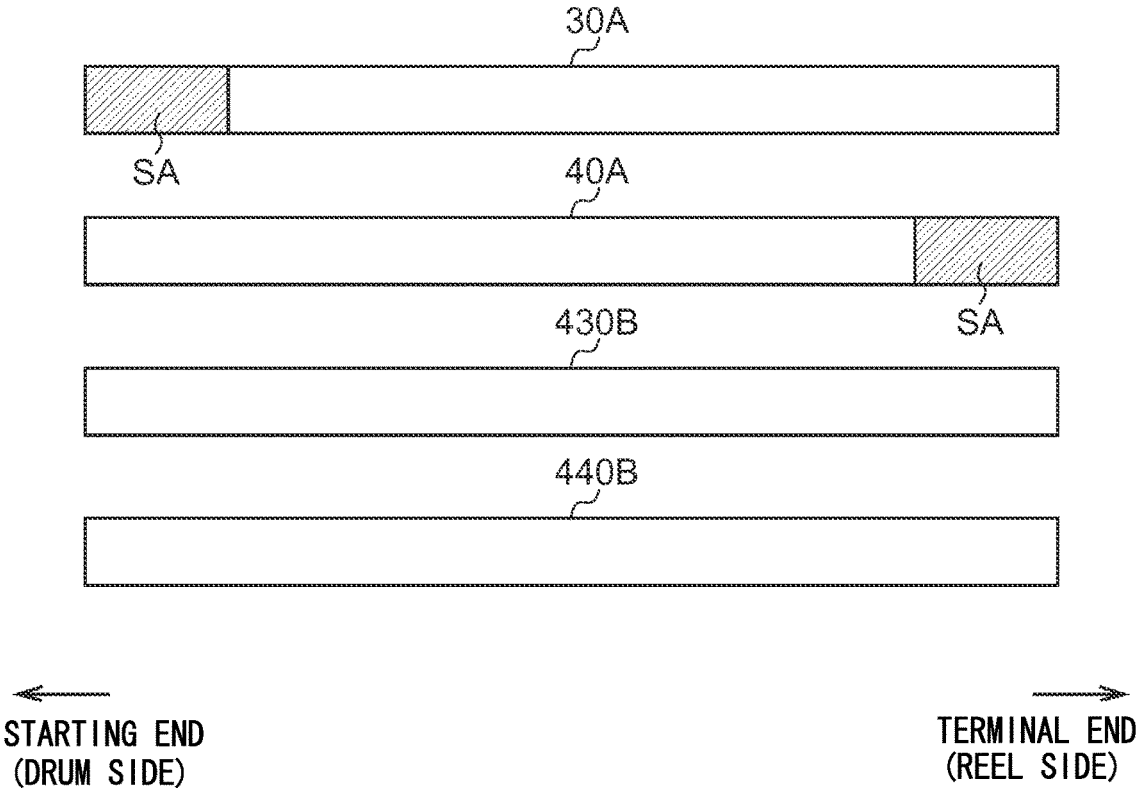
FIG. 23 is a schematic diagram illustrating a configuration (2) of the conventional tape.

Specifically, compared to the conventional temporary holding unit 415 (FIGS. 22A and 22B), the temporary holding unit 15 further includes the tape sensor 45B, and the light-shielding region SA is formed on the terminal end of the inner tape 40B.

In other words, in the temporary holding unit 15, as for the starting end of each tape, the light-shielding region SA is formed only on the outer tape 30A in the tape running system 27A, i.e., only on the outer tape 30 in one of the tape running systems 27.

On the other hand, in the temporary holding unit 15, as for the terminal end of each tape, the light-shielding region SA is formed on both the inner tapes 40A and 40B, i.e., on the inner tape 40 in all tape running systems 27.

Figure 5:
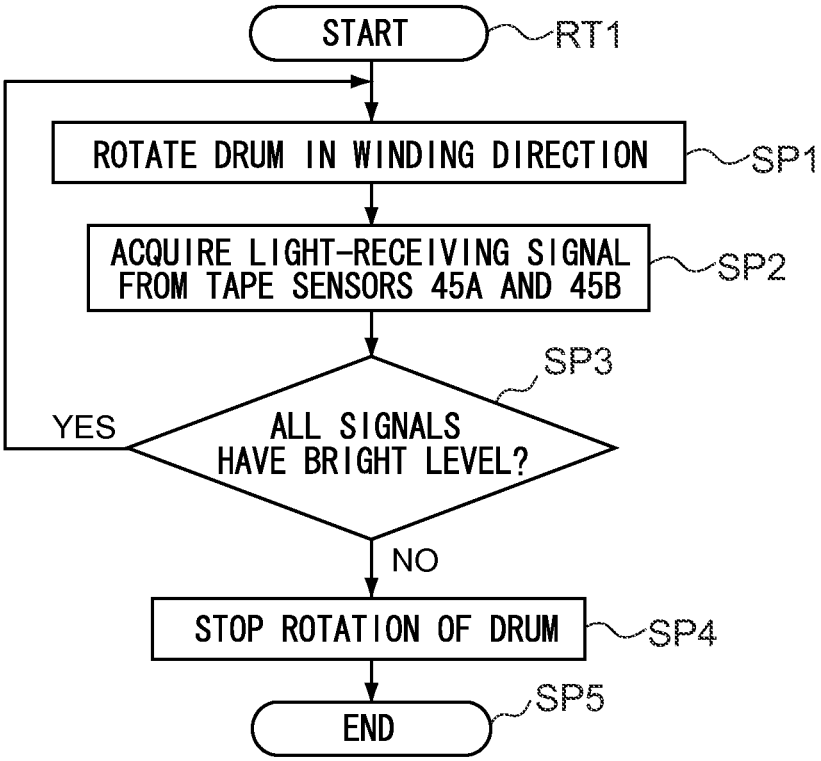
FIG. 5 is a flowchart illustrating a winding procedure according to the first embodiment.

In this configuration, when successively winding each tape and the bill BL around the drum 23, the control unit 21 in the temporary holding unit 15 controls the rotation of the drum 23 according to a flowchart illustrated in FIG. 5.

Specifically, when accepting an instruction of holding the bill BL inside from the bill control unit 11 (FIG. 2) and so on, the control unit 21 in the temporary holding unit 15 starts a winding procedure RT1, and proceeds to step SP1.

In step SP1, the control unit 21 rotates the drum 23 in the winding direction R1, and then, proceeds to next step SP2. The control unit 21 rotates the drum 23 by each predetermined angle by controlling a stepping motor, not illustrated.

In step SP2, the control unit 21 acquires the light-receiving signals from the tape sensors 45A and 45B, and then, proceeds to next step SP3.

In step SP3, the control unit 21 determines whether all of the acquired light-receiving signals have a "bright" level or not. The case in which a positive result is obtained means that neither the tape position of the inner tape 40A nor the tape position of the inner tape 40B reaches its terminal end portion. Specifically, the temporary holding unit 15 is unlikely to damage each tape, even if the temporary holding unit 15 continues to rotate the drum 23 in the winding direction R1. Therefore, the control unit 21 returns again step SP1 to continue the rotation of the drum 23.

On the other hand, the case in which a negative result is obtained in step SP3 means that at least either one of the tape position of the inner tape 40A or the tape position of the inner tape 40B reaches its terminal end portion, on which the light-shielding region SA is formed. Specifically, the temporary holding unit 15 is likely to damage each tape, when continuing to rotate the drum 23 in the winding direction R1. Therefore, the control unit 21 proceeds to next step SP4.

In step SP4, the control unit 21 stops the rotation of the drum 23, and then, proceeds to next step SP5 to end the winding procedure RT1.

As described above, the control unit 21 in the temporary holding unit 15 is configured to stop the rotation of the drum 23 at the time when at least either one of the tape position of the inner tape 40A or the tape position the inner tape 40B reaches its terminal end portion by monitoring the light-receiving signals from both tape sensors 45A and 45B, while rotating the drum 23 in the winding direction R1.

The length of the inner tape 40A and the inner tape 40B from the terminal end portion to the light-shielding region SA is appropriately set such that the light-shielding region SA reaches the positions of the tape sensors 45A and 45B before the inner tapes 40A and 40B wound around the inner reel 41A and the inner reel 41B are completely drawn.

When accepting an instruction of discharging the bill BL held inside to the outside from the bill control unit 11 (FIG. 2) and so on, the temporary holding unit 15 starts a rewinding procedure RT2, and then, proceeds to step SP11.

In step SP11, the control unit 21 rotates the drum 23 in the rewinding direction R2, and then, proceeds to next step SP12. In step SP12, the control unit 21 acquires the light-receiving signal from the tape sensor 35A, and then, proceeds to next step SP13.

In step SP13, the control unit 21 determines whether the acquired light-receiving signal has a "bright" level or not. The case in which a positive result is obtained means that the tape position of the outer tape 30A does not reach its terminal end portion. Specifically, the temporary holding unit 15 is unlikely to damage each tape, even if the temporary holding unit 15 continues to rotate the drum 23 in the rewinding direction R2. Therefore, the control unit 21 returns to step SP11 to continue the rotation of the drum 23.

On the other hand, the case in which a negative result is obtained in step SP13 means that the tape position of the outer tape 30A reaches its starting end portion on which the light-shielding region SA is formed. Specifically, the temporary holding unit 15 is likely to damage each tape, if the rotation of the drum 23 is continued in the rewinding direction R2. Therefore, the control unit 21 proceeds to next step SP14.

In step SP14, the control unit 21 stops the rotation of the drum 23, and then, proceeds to next step SP15 to end the rewinding procedure RT2.

As described above, the control unit 21 in the temporary holding unit 15 is configured to stop the rotation of the drum 23 at the time when the tape position of the outer tape 30A reaches its starting end portion by monitoring the light-receiving signal from the tape sensor 35A, while rotating the drum 23 in the rewinding direction R2.

The length of the outer tape 30A from the starting end portion to the light-shielding region SA is appropriately set such that the light-shielding region SA reaches the position of the tape sensor 35A before the outer tape 30A wound around the peripheral side face of the drum 23 is completely rewound.

Differently from the case of winding each tape around the drum 23 with the bill BL sandwiched between the drum and the tape, the winding diameter of each tape is almost equal for each of the reels and all tapes reach their starting end portion at almost the same time, since the temporary holding unit 15 winds only each tape around each reel, when winding each tape around each reel.

Therefore, in the temporary holding unit 15, the light-shielding region SA is formed on the starting end portion of only one of the outer tape 30A, and this light-shielding region SA is detected by the tape sensor 35A.

[1-3. Operation and Effect]

In the configuration described above, in the temporary holding unit 15 according to the first embodiment, the tape sensor 45B in the tape running system 27B is provided in addition to the tape sensor 45A at the tape running system 27A, and the light-shielding region SA is formed on the terminal end portion of the inner tape 40B.

During the winding operation of the drum 23, the control unit 21 in the temporary holding unit 15 monitors the light-receiving signals from the tape sensors 45A and 45B. When detecting that at least one of the light-receiving signals has the "dark" level and detecting the light-shielding region SA, the control unit 21 determines that the terminal end portion is reached and stops the rotation of the drum 23.

Accordingly, the temporary holding unit 15 can stop the winding operation of the drum 23, even if either one of the inner tape 40A or 40B reaches its terminal end portion during the winding operation of the drum 23, whereby the temporary holding unit 15 can prevent damage due to an application of excessive tensile force to each tape from occurring.

Figure 7A:
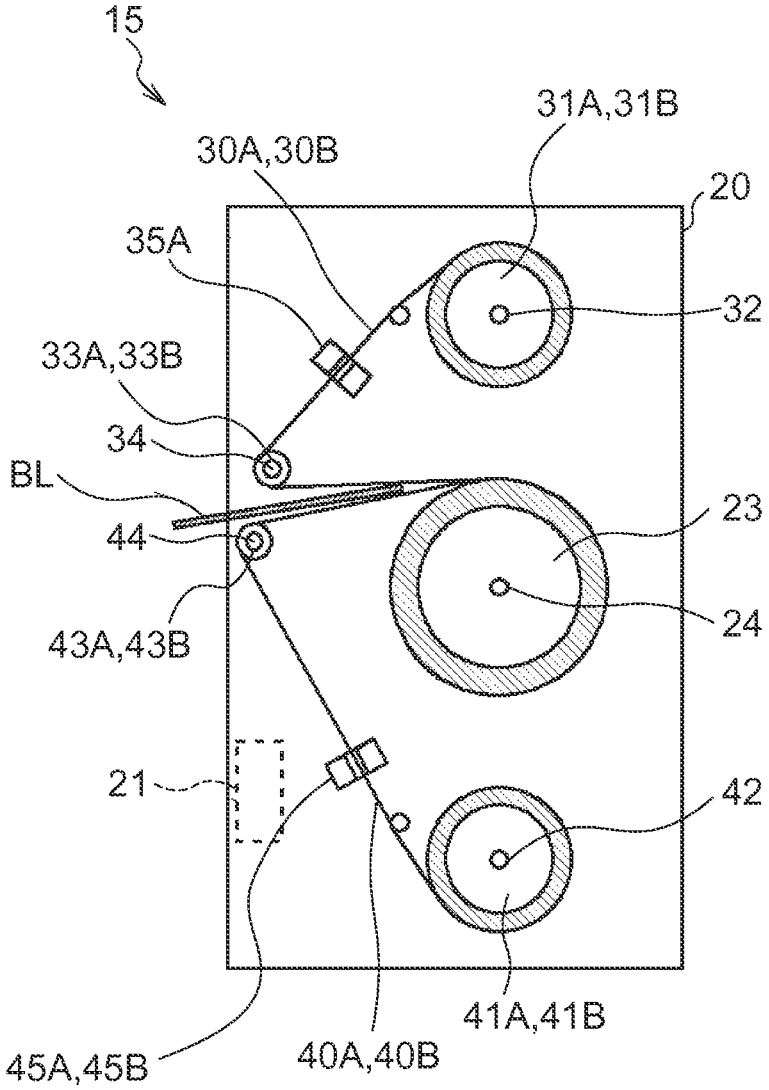
FIG. 7A is a right side view illustrating a state in which a winding diameter is not uniform in the first embodiment.
Figure 7B:
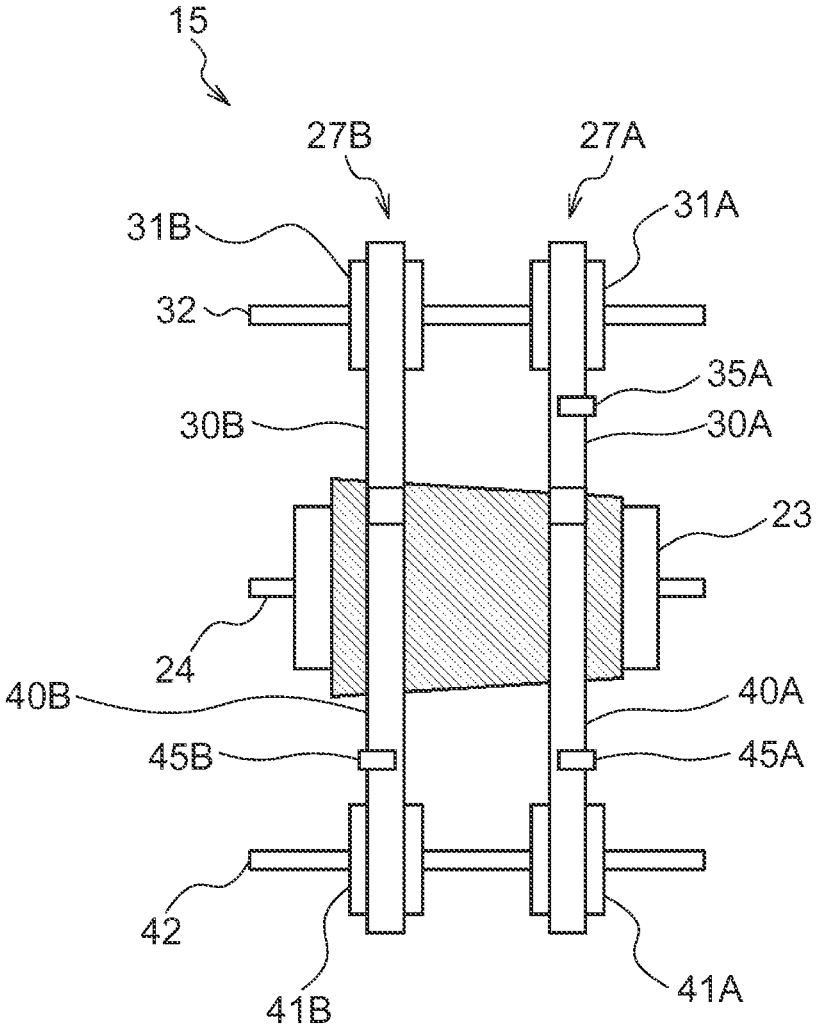
FIG. 7B is a back view illustrating the state in which the winding diameter is not uniform in the first embodiment.
Figure 24A:
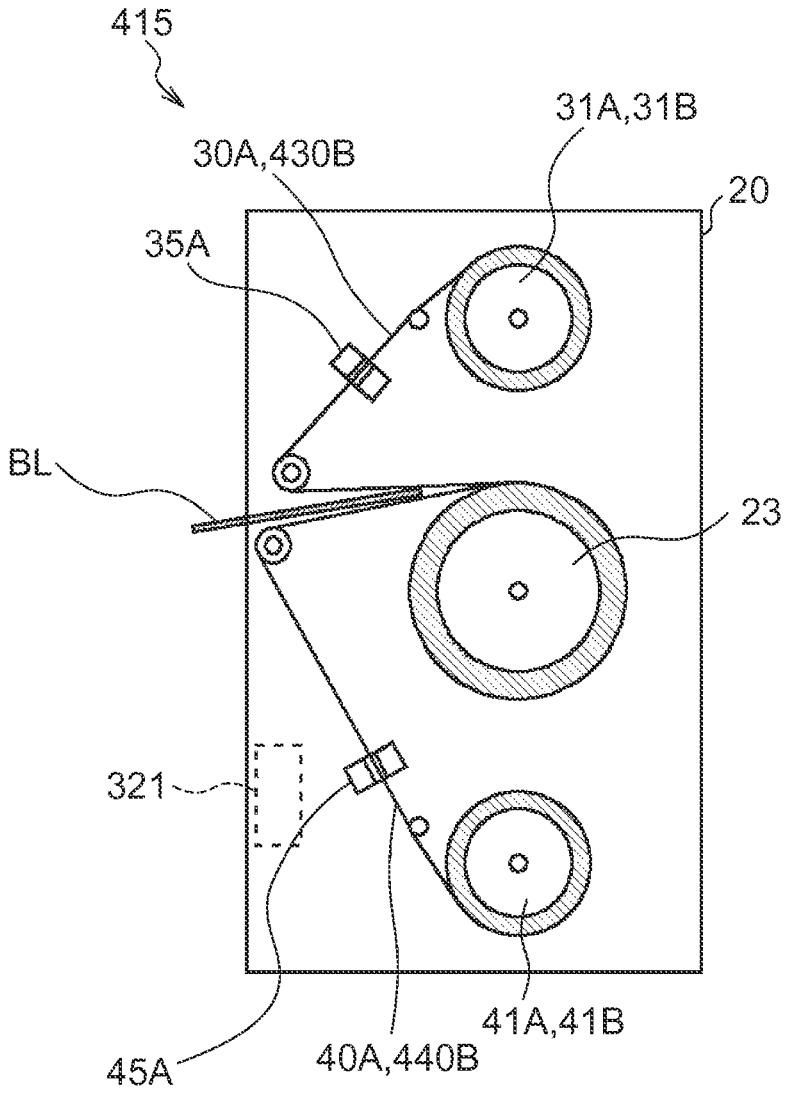
FIG. 24A is a right side view illustrating a state in which a deviation is caused in a winding diameter in a conventional temporary holding unit.
Figure 24B:
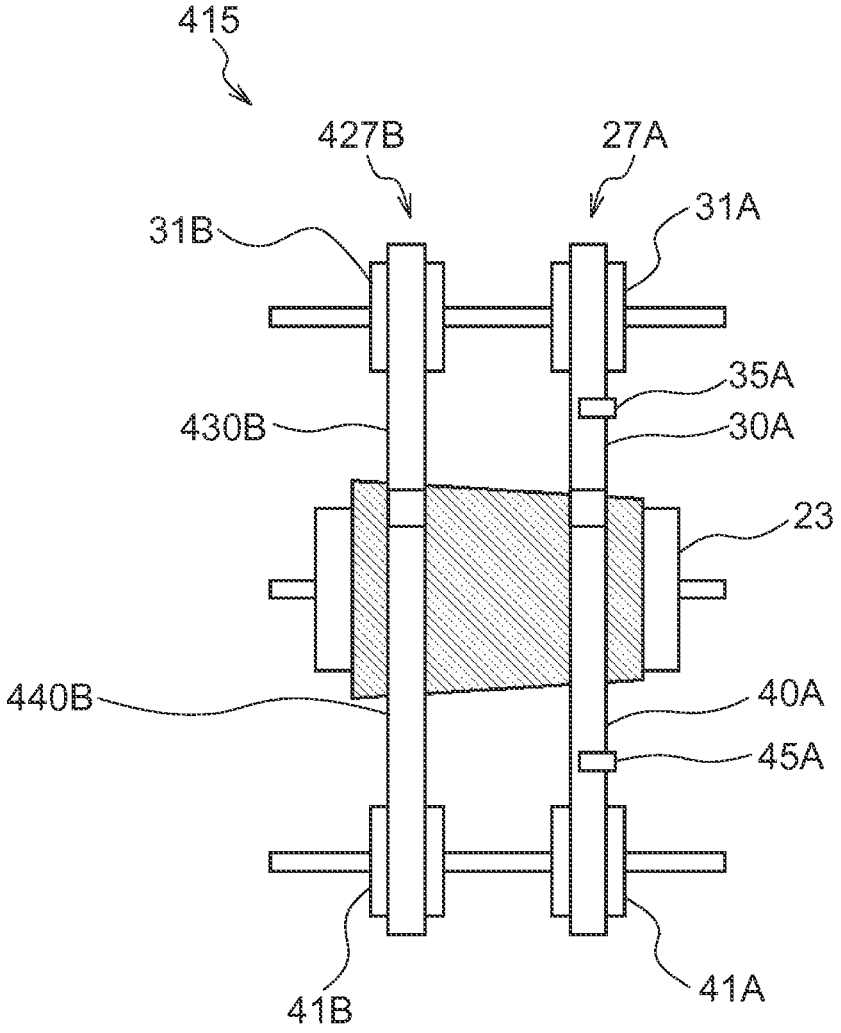
FIG. 24B is a back view illustrating the state in which a deviation is caused in the winding diameter in the conventional temporary holding unit.

In the temporary holding unit 15, it is particularly considered that the winding diameter (the apparent outer diameter including the wound bill BL) of the drum 23 is differing between the tape running systems 27A and 27B due to wrinkles on the bill BL as the same as the case in the conventional temporary holding unit 415, as illustrated in FIGS. 7A and 7B corresponding to FIGS. 24A and 24B.

Even in this case, when the inner tape 40 (in this case, the inner tape 40B), which has the larger winding diameter, reaches its terminal end portion first, the temporary holding unit 15 can detect the light-shielding region SA on the inner tape 40B by the tape sensor 45B. Accordingly, the temporary holding unit 15 can surely stop the rotation of the drum 23.

Compared to the conventional temporary holding unit 415, in the temporary holding unit 15, the tape sensor 45B similar to the tape sensor 45A may be provided, the light-shielding region SA similar to the one on the inner tape 40A may be formed on the terminal end portion of the inner tape 40B, and a part of the winding procedure by the control unit 21 may be changed. Accordingly, the increase in components and the complication of the manufacturing processing caused by the change in the configuration can be reduced as much as possible.

According to the configuration described above, in the temporary holding unit 15 according to the first embodiment, the tape sensors 45A and 45B are provided at the tape running systems 27A and 27B, and the light-shielding region SA is formed on the terminal end portion of each of the inner tapes 40A and 40B. The control unit 21 in the temporary holding unit 15 monitors the light-receiving signals from the tape sensors 45A and 45B during the winding operation of the drum 23, and the control unit 21 stops the rotation of the drum 23 at the time when the control unit 21 determines that either one of the light-receiving signals has the "dark" level and detects the light-shielding region SA. Accordingly, the temporary holding unit 15 can stop the winding operation of the drum 23 at the time when either one of the inner tape 40A or 40B reaches its terminal end portion first during the winding operation of the drum 23, and it is possible to prevent damage due to an application of excessive tensile force to each tape from occurring.

[2. Second Embodiment]

An automated teller machine 101 (FIG. 1) according to a second embodiment is almost the same as the automated teller machine 1 according to the first embodiment, except that a temporary holding unit 115 is employed instead of the temporary holding unit 15.

[2-1. Configuration of Temporary Holding Unit]

Figure 8A:
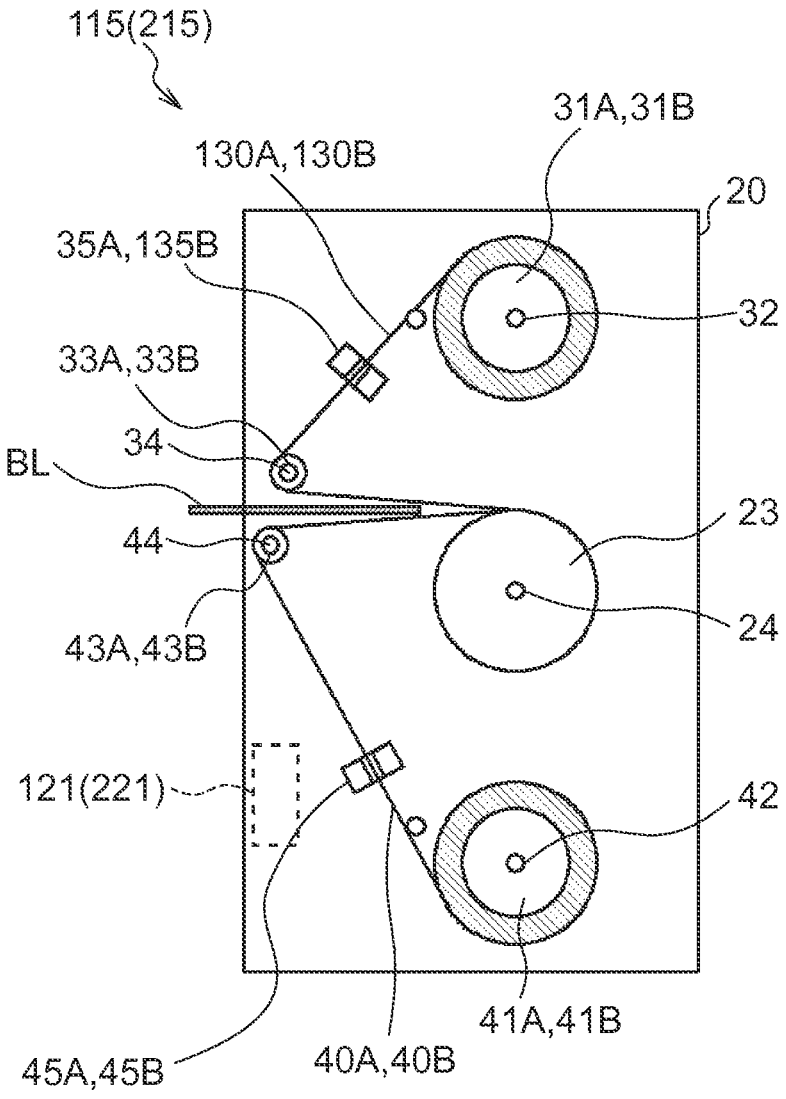
FIG. 8A is a right side view illustrating configurations of temporary holding units according to second and third embodiments.
Figure 8B:
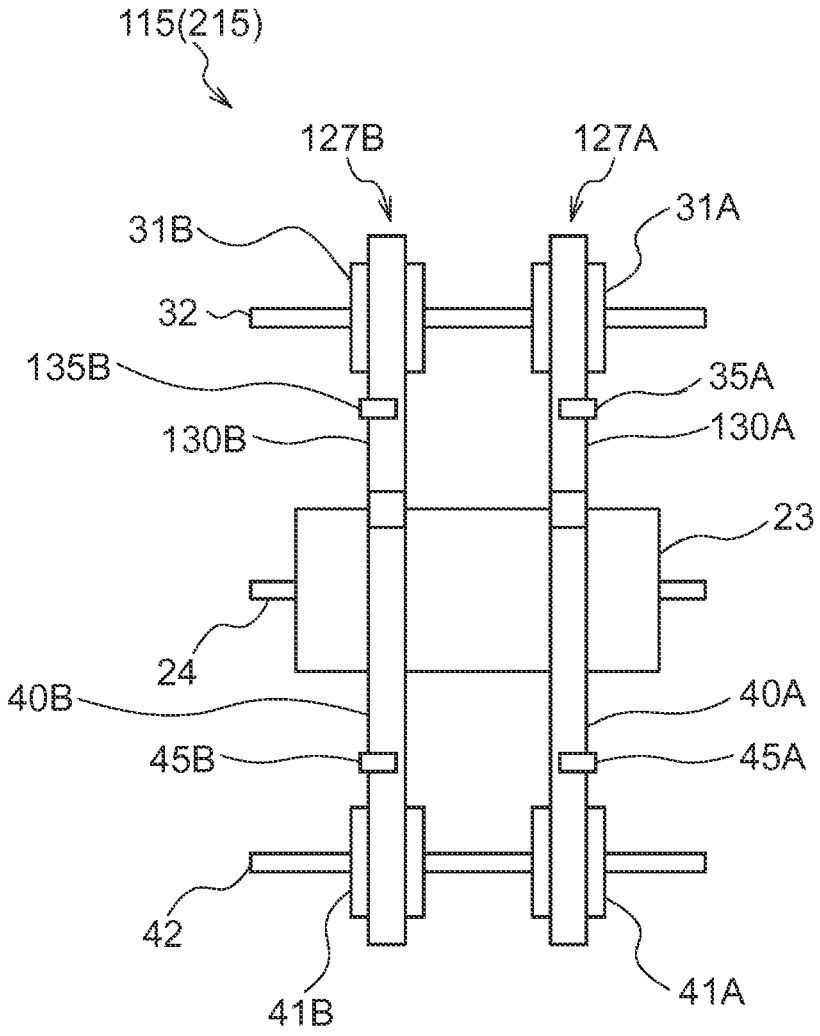
FIG. 8B is a back view illustrating the configurations of the temporary holding units according to the second and third embodiments.

As illustrated in FIGS. 8A and 8B in which components corresponding to those in FIGS. 3A and 3B are identified by the same numerals, the temporary holding unit 115 is different from the temporary holding unit 15 according to the first embodiment in that the temporary holding unit 115 includes a control unit 121, a tape running system 127A, and a tape running system 127B, instead of the control unit 21, the tape running system 27A, and the tape running system 27B, however, the other parts of the temporary holding unit 115 is similarly configured as the temporary holding unit 15 according to the first embodiment except that.

The control unit 121 has a CPU, a storage unit, and the like, not illustrated, to perform various control and processing involved with the rotation of the drum and the running of the tape, like the control unit 21. However, the control unit 121 is different from the control unit 21 in that the control unit 121 executes a winding procedure RT3 (described later) instead of the winding procedure RT1.

The tape running system 127A is different from the tape running system 27A in that the tape running system 127A has an outer tape 130A instead of the outer tape 30A, however, the other parts of he tape running system 127A is similarly configured as the tape running system 27A.

The tape running system 127B is different from the tape running system 27B in that the tape running system 127B has an outer tape 130B instead of the outer tape 30B, and a tape sensor 135B similar to the tape sensor 35A, however, the other parts of the tape running system 127B is similarly configured as the tape running system 27B.

Figure 9:
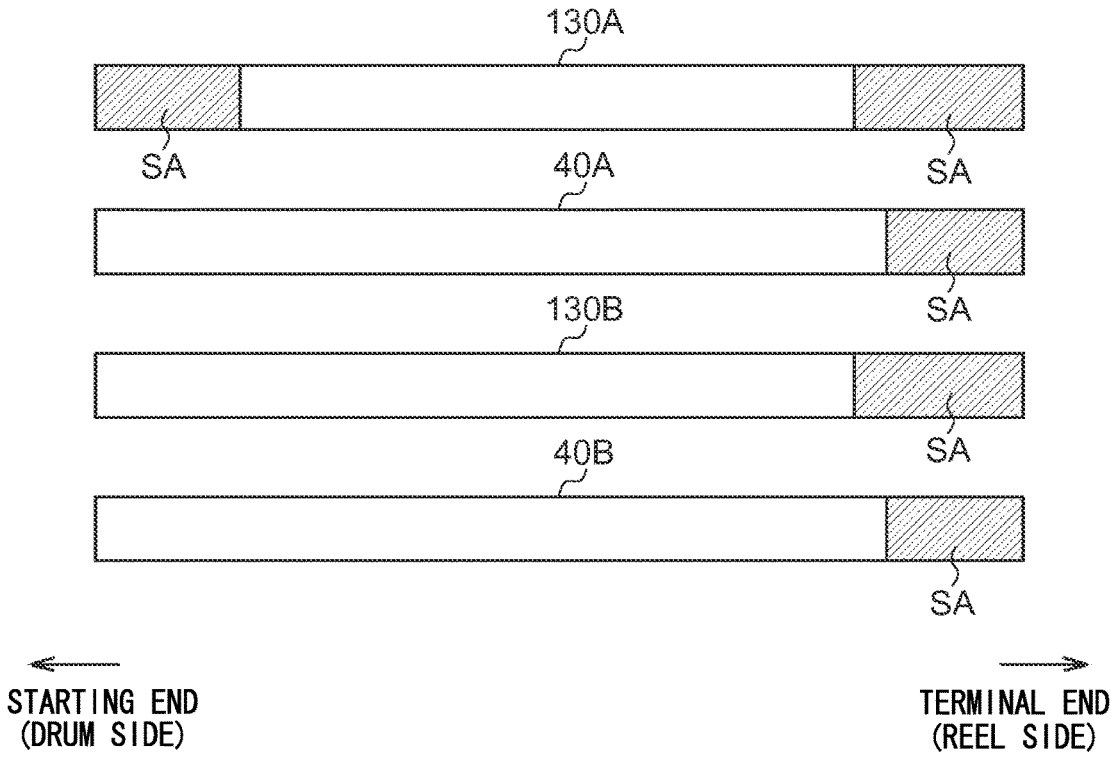
FIG. 9 is a schematic side view illustrating a configuration of a tape according to the second embodiment.

The outer tapes 130A and 130B have a light-shielding region SA on their terminal end portions as the inner tapes 40A and 40B illustrated in FIG. 9 in which the components corresponding to those in FIG. 4 are identified by the same numerals.

The lengths of the outer tapes 130A and 130B from their terminal end portions to the light-shielding region SA are appropriately set such that the light-shielding region SA reaches the positions of the tape sensors 35A and 135B before the outer tapes 130A and 130B wound around the outer reels 31A and 31B are completely drawn.

In the temporary holding unit 115, the length of the path of the outer tapes 130A and 130B from the outer reels 31A and 31B to the tape sensors 35A and 135B is different from the length of the path of the inner tapes 40A and 40B from the inner reels 41A and 41B to the tape sensors 45A and 45B. Therefore, the length from the terminal end portion to the light-shielding region SA on the outer tapes 130A and 130B is different from that on the inner tapes 40A and 40B.

Figure 10:
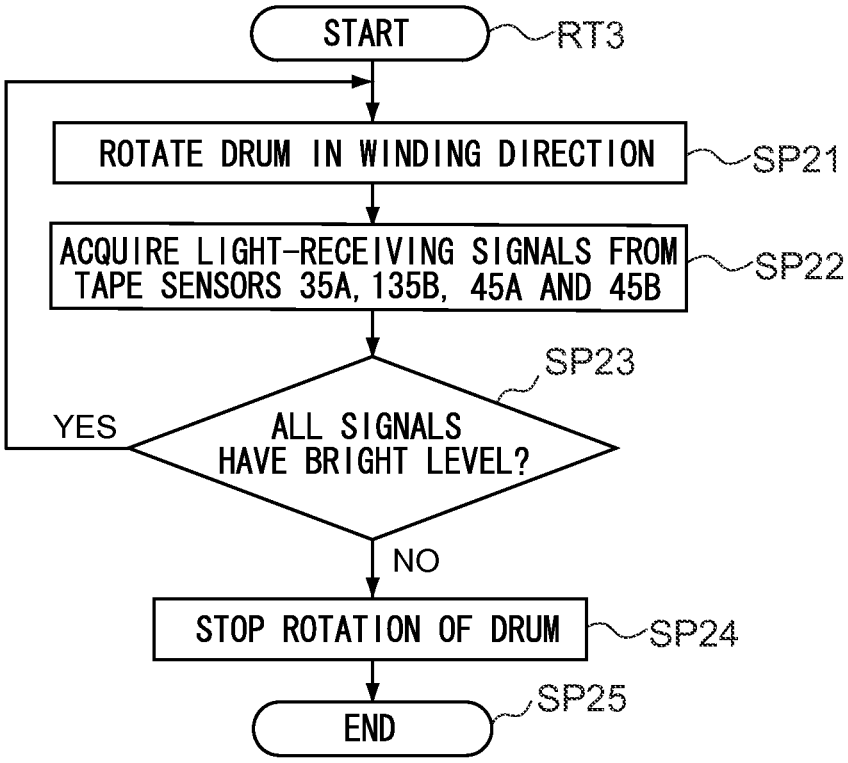
FIG. 10 is a flowchart illustrating a winding procedure according to the second embodiment.

The control unit 121 controls the rotation of the drum 23 according to a flowchart illustrated in FIG. 10 corresponding to FIG. 5 while successively winding each tape and the bill BL around the drum 23.

Specifically, when accepting an instruction of holding the bill BL inside from the bill control unit 11 (FIG. 2), the control unit 121 in the temporary holding unit 115 starts a winding procedure RT3, and proceeds to step SP21.

In step SP21, the control unit 121 rotates the drum 23 in the winding direction R1 as in step SP1, and then, proceeds to step SP22.

In step SP22, the control unit 121 acquires light-receiving signals from all tape sensors, i.e., from the tape sensors 35A and 135B and the tape sensors 45A and 45B, and then, proceeds to step SP23.

In step SP23, the control unit 121 determines whether all of the acquired light-receiving signals have a "bright" level or not. The case in which a positive result is obtained means that none of the tape positions of the outer tapes 130A and 130B and the inner tapes 40A and 40B reach their terminal end portion. Specifically, the temporary holding unit 115 is unlikely to damage each tape, even if it continues to rotate the drum 23 in the winding direction R1. Therefore, the control unit 121 returns to step SP21 to continue the rotation of the drum 23.

On the other hand, the case in which a negative result is obtained in step SP23 means that at least one of the tape position of the outer tape 130A or 130B or the tape position of the inner tape 40A or 40B reaches its terminal end. Specifically, the temporary holding unit 115 is likely to damage each tape, when continuing to rotate the drum 23 in the winding direction R1. Therefore, the control unit 121 proceeds to next step SP24.

In step SP24, the control unit 121 stops the rotation of the drum 23 as in step SP4, and then, proceeds to next step SP25 to end the winding procedure RT3.

As described above, the control unit 121 in the temporary holding unit 115 is configured to stop the rotation of the drum 23 at the time when at least one of the outer tape 130A or 130B or the inner tape 40A or 40B reaches its terminal end by monitoring the light-receiving signals from the tape sensors 35A and 135B and the tape sensors 45A and 45B, while rotating of the drum 23 in the winding direction R1.

The control unit 121 is configured to control the rotation and stop of the drum 23 by executing the rewinding procedure RT2 (FIG. 6) as in the first embodiment, when accepting an instruction of discharging the bill BL held inside to the outside from the bill control unit 11 (FIG. 2) and so on.

[2-2. Operation and Effect]

In the configuration described above, in the temporary holding unit 115 according to the second embodiment, the tape sensor 135B, similar to the tape sensor 35A is provided at the tape running system 127B, and the light-shielding regions SA are formed on the terminal end portions of the outer tapes 130A and 130B.

During the winding operation of the drum 23, the control unit 121 in the temporary holding unit 115 monitors the light-receiving signals from the tape sensors 35A and 135B and the tape sensors 45A and 45B. The control unit 121 detects the light-shielding region SA when detecting that at least one of the light-receiving signals has the "dark" level, the control unit 121 determines that a corresponding tape reaches its terminal end, and stops the rotation of the drum 23.

Accordingly, the temporary holding unit 115 can stop the winding operation of the drum 23, at the time when at least one of the tape position of the outer tape 130A or 130B or the tape position of the inner tape 40A or 40B reaches its terminal end portion during the winding operation of the drum 23, whereby the temporary holding unit 115 can prevent damage due to an application of excessive tensile force to each tape from occurring.

In the temporary holding unit 115, when a bill BL having a crease or wrinkle is conveyed and wound, this bill BL interferes with the peripheral components to cause a jam, and each tape might got entangled or might be cut due to this jam. It is also considered that a maintenance worker erroneously cuts the tape during a maintenance operation.

In this case, the tape is originally replaced by a new tape in the temporary holding unit 115. However, when it takes time to get a new tape, the tape might be cut short in such a manner that the entangled portion of the tape is cut off, and the remaining portions are bonded to each other at a bonding portion CP, as an emergent measure.

Figure 11:
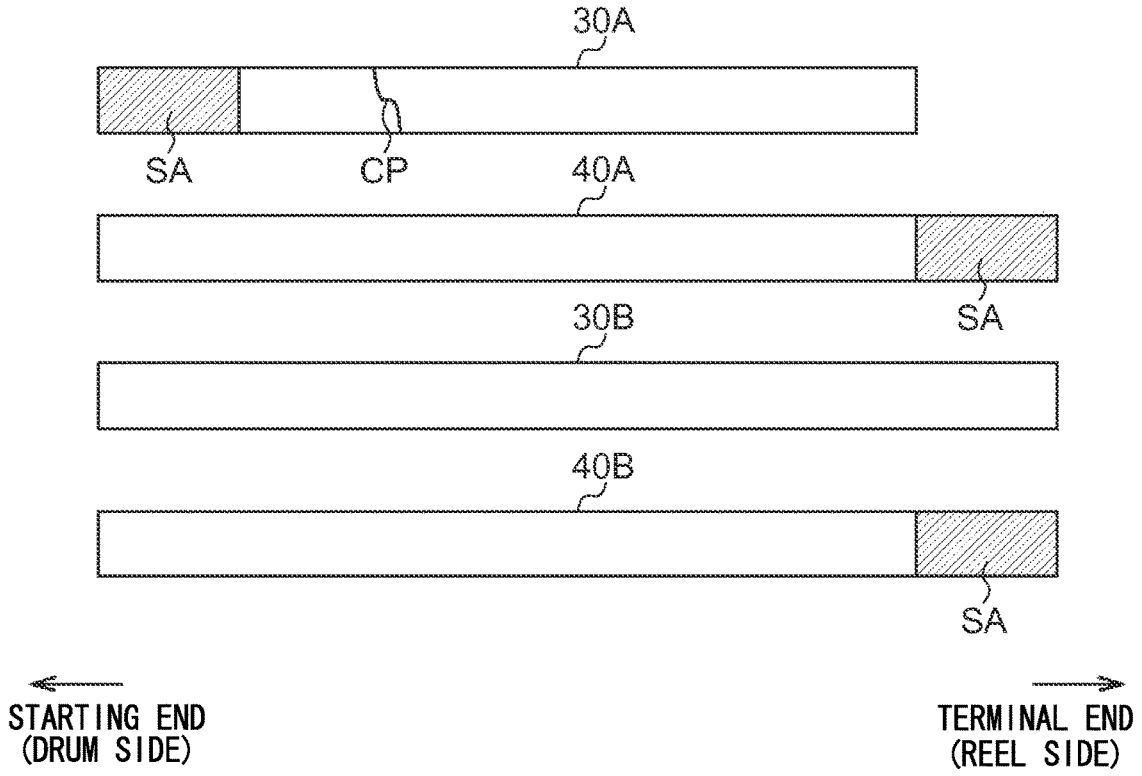
FIG. 11 is a schematic diagram illustrating a state (1) in which a tape is cut short.

For example, it is assumed that the outer tape 30A, on which no light-shielding region SA is formed at its terminal end portion, is cut short in the temporary holding unit 15 according to the first embodiment as illustrated in FIG. 11.

In the temporary holding unit 15, if the winding operation is performed, this outer tape 30A reaches its terminal end portion before the tape sensor 45A or 45B detects the light-shielding region SA on the inner tape 40A or 40B, whereby malfunction might occur, and excessive tensile force might be applied to the outer tape 30A.

Figure 12:
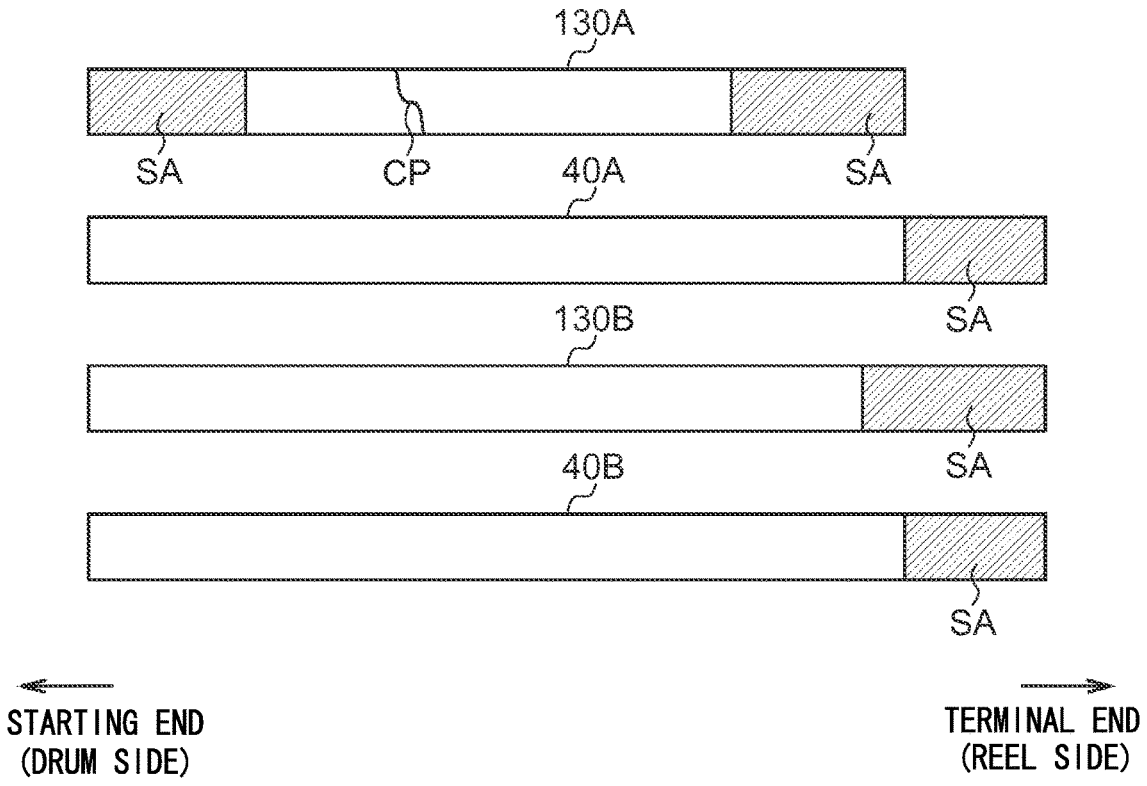
FIG. 12 is a schematic diagram illustrating a state (2) in which a tape is cut short.

On the other hand, in the temporary holding unit 115, even if the winding operation is carried out with the outer tape 130A which is cut short as illustrated in FIG. 12, the tape sensor 35A detects the light-shielding region SA formed at the terminal end portion of the outer tape 130A, whereby the rotation of the drum 23 can be stopped.

Specifically, in the temporary holding unit 115, the light-shielding regions SA are formed on the terminal end portions of all tapes (the outer tapes 130A and 130B, and the inner tapes 40A and 40B), and the tape sensors (the tape sensors 35A, 135B, 45A, and 45B) corresponding to these tapes are provided. Therefore, even if any one of the tapes is cut short, it can be detected that the shortest tape reaches its terminal end portion at the time when the shortest tape first reaches its terminal end portion, and the rotation of the drum 23 can be stopped, and the temporary holding unit 115 can prevent the occurrence of malfunction and the application of excessive tensile force to a tape.

The temporary holding unit 115 can achieve the operation and effect similar to those of the temporary holding unit 15 according to the first embodiment in other aspects.

According to the configuration described above, in the temporary holding unit 115 according to the second embodiment, the tape sensors 35A, 135B, 45A, and 45B are provided, and the light-shielding regions SA are formed at the terminal end portion of each of the outer tapes 130A and 130B and the inner tapes 40A and 40B. The control unit 121 in the temporary holding unit 115 monitors the light-receiving signals from the tape sensors 35A, 135B, 45A and 45B during the winding operation of the drum 23, and the control unit 121 stops the rotation of the drum 23 at the time when the control unit 121 determines that any one of the light-receiving signals has the "dark" level and detects the light-shielding region SA. Accordingly, the temporary holding unit 115 can immediately stop the winding operation of the drum 23 at the time when any one of the outer tape 130A or 130B or the inner tape 40A or 40B first reaches its terminal end portion during the winding operation of the drum 23, thereby being capable of preventing damage due to an application of excessive tensile force to each tape from occurring.

[3. Third Embodiment]

An automated teller machine 201 (FIG. 1) according to a third embodiment is different from the automated teller machine 101 according to the second embodiment in that a temporary holding unit 215 is employed instead of the temporary holding unit 115, however, the other parts of the automated teller machine 201 (FIG. 1) according to a third embodiment is almost the same as the automated teller machine 101 according to the second embodiment.

[3-1. Configuration of Temporary Holding Unit]

The temporary holding unit 215 is different from the temporary holding unit 115 according to the second embodiment in that the temporary holding unit 215 includes a control unit 221 instead of the control unit 121, however, the other parts of the temporary holding unit 215 is the same as the temporary holding unit 115 according to the second embodiment.

The control unit 221 has a CPU, a storage unit, and the like, not illustrated, to perform various controls and processing involved with the rotation of the drum and the running of the tape, like the control unit 121. However, the control unit 221 is different from the control unit 121 in that the control unit 221 executes a later-described tape position determination procedure RT4 and a winding procedure RT5 (described later) instead of the winding procedure RT3 according to the second embodiment.

As in the second embodiment, in the temporary holding unit 215, the light-shielding region SA is formed on the terminal end portions of all tapes (the outer tapes 130A and 130B and the inner tapes 40A and 40B), and the light-shielding region SA is also formed on the starting end portion of the outer tape 130A (FIG. 9).

In the temporary holding unit 215, the case in which only the light-receiving signal from the outer tape sensor 35A has the "dark" level means that the temporary holding unit 215 detects the light-shielding region SA. However, in this case, the tape position is not always the starting end portion, but there is a possibility that the tape position is the terminal end portion, i.e., a possibility that only the outer tape 30A reaches its terminal end portion earlier than the other tapes due to reasons such as a variation in the lengths of the tapes.

Therefore, the control unit 221 does not immediately determine the tape position based upon the light-receiving signal acquired from each tape sensor (35A, 135B, 45A, and 45B), but classifies a "status", which indicates a state that can be determined from only the light-receiving signal, into three types, and finally determines the tape position based upon this "status".

In this case, the control unit 221 determines the status as any one of a "middle portion determined state", a "terminal end portion determined state", and an "undetermined state" based upon four light-receiving signals from the respective tape sensors according to a status table TBL1 illustrated in FIG. 13, and records the status.

Specifically, if all light-receiving signals have the "bright" level, the control unit 221 determines the status as the "middle portion determined state", since it is determined that the tape position is neither the starting end portion nor the terminal end portion, but the middle portion.

If only the light-receiving signal from the tape sensor 35A has the "dark" level, the control unit 221 determines the status as the "undetermined state", since it cannot be determined whether the tape position is the starting end portion or the terminal end portion.

In other case, i.e., if at least any one of the light-receiving signal from the tape sensor 45A, 135B, or 45B has the "dark" level, in other words, if the light-shielding region SA of at least any one of the outer tape 130B or the inner tape 40A or 40B is detected, the control unit 221 determines the status as the "terminal end portion determined state", since it is determined that the tape position is the terminal end portion.

Figure 14:
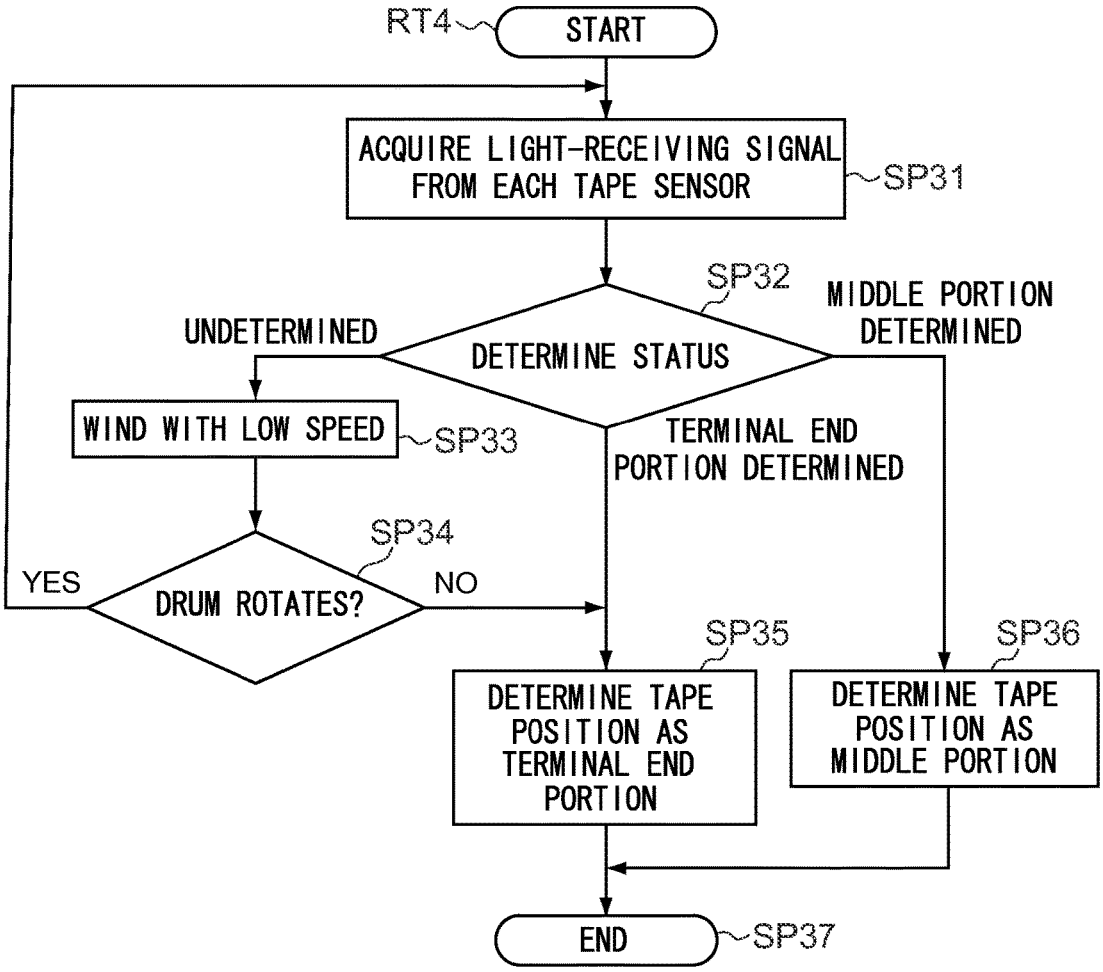
FIG. 14 is a flowchart illustrating a determination procedure of a tape position upon a start.

The control unit 221 can determine the status just after the power source of the automated teller machine 201 is turned on to start the temporary holding unit 215, however, the control unit 221 cannot determine the tape position when the status becomes the undetermined state. Therefore, just after the start of the temporary holding unit 215, the control unit 221 is configured to execute a flowchart illustrated in FIG. 14.

Specifically, after the temporary holding unit 215 is started, the control unit 221 starts the tape position determination procedure RT4 at the time of the start, and then, proceeds to step SP31. In step SP31, the control unit 221 acquires a light-receiving signal from each tape sensor, determines whether each light-receiving signal has the "bright" level or the "dark" level, and then, proceeds to step SP32.

In step SP32, the control unit 221 compares the acquired four light-receiving signals to the status table TBL1 (FIG. 13), thereby determining the status. If the status is the "undetermined state", the tape position is either one of the "starting end portion" and the "terminal end portion", but it cannot be determined at present which one of the "starting end portion" and the "terminal end portion" this tape position is. In this case, the control unit 221 proceeds to step SP33.

In step SP33, the control unit 221 controls to rotate the drum 23 in the winding direction R1 with low speed, and then, proceeds to step SP34.

In step SP34, the control unit 221 determines whether or not the drum 23 actually rotates based upon a rotation signal transmitted from the drum 23. The case in which a positive result is obtained represents a possibility that the tape might be slightly wound due to the rotation of the drum 23, i.e., the tape position might be slightly changed, and the status is also changed. Therefore, the control unit 221 returns to step SP31 to determine the status again.

On the other hand, the case in which a negative result is obtained in step SP34 represents that the drum does not rotate even if the control unit 221 tries to rotate the drum 23, i.e., any one of the tapes reaches its terminal end portion. Therefore, the control unit 221 proceeds to step SP35.

The case in which the status is the "terminal end portion determined state" in step SP32 represents that at least one of the outer tape 130B or the inner tape 40A or 40B reaches its terminal end portion. In this case, the control unit 221 proceeds to step SP35.

In step SP35, after determining that the tape position is the terminal end portion, the control unit 221 proceeds to step SP37 to end the tape position determination procedure RT4 upon the start.

When the status is the "middle portion determined state" in step SP32, the tape position of each tape is the middle portion, so that the control unit 221 proceeds to step SP36.

In step SP36, the control unit 221 determines the tape position as the middle portion, and then, proceeds to step SP37 to end the tape position determination procedure RT4 upon the start.

As described above, when the tape position is undetermined, the control unit 221 determines the tape position by rotating the drum 23 with low speed as well as based upon the light-receiving signal from each tape sensor.

Figure 15:
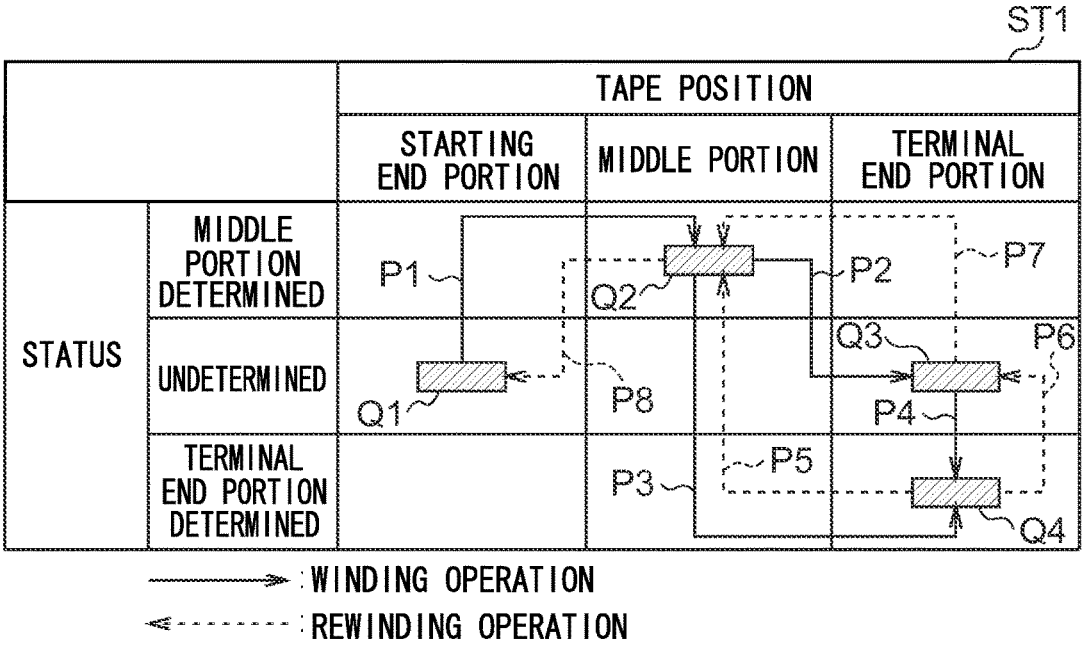
FIG. 15 is a schematic diagram illustrating a relationship between the status and the tape position, and a change in the winding operation and the rewinding operation.

When the winding operation or the rewinding operation is carried out after the determination of the tape position, the temporary holding unit 215 updates the tape position in accordance with a status transition diagram ST1 illustrated in FIG. 15.

In the status transition diagram ST1, vertical columns indicate a status, and horizontal rows indicate a tape position. A rectangular transition mode Q indicates a combination of both the status and the tape position. A solid line indicates the winding operation, and the status is changed to the right or in the up-down direction in the figure. A broken line indicates the rewinding operation, and the status is changed to the left or in the up-down direction.

When the tape position is the "starting end portion", the control unit 221 in the temporary holding unit 215 determines the status as the "undetermined state", so that the transition mode becomes Q1. When the control unit 221 performs the winding operation, and the status is changed to the "middle portion determined state", the control unit 221 changes the transition mode to Q2 along an arrow P1, thereby setting the tape position as the "middle portion".

When the control unit 221 further carries out the winding operation, and the status becomes the "undetermined state" or the "terminal end portion determined state", the control unit 221 changes the transition mode to Q3 or Q4 along an arrow P2 or P3, thereby setting the tape position as the "terminal end portion". When the control unit 221 carries out the winding operation in the transition mode Q3 where the status is the "middle portion determined state", and the status becomes the "terminal end portion determined state", the control unit 221 changes the transition mode to Q4 along an arrow P4.

When the control unit 221 carries out the rewinding operation in the transition mode Q4 where the status is the "terminal end portion determined state" and the tape position is the "terminal end portion", the control unit 221 changes the mode to the transition mode Q2 along an arrow P5 to set the tape position as the "middle portion" if the status becomes the "middle portion determined state", and changes the mode to the transition mode Q3 along an arrow P6 to keep the tape position as the "terminal end portion" if the status becomes the "undetermined state". The control unit 221 carries out the rewinding operation in the transition mode Q3. If the status becomes the "middle portion determined state", the control unit 221 changes the mode to the transition mode Q2 along an arrow P7 to set the tape position as the "middle portion".

When the control unit 221 further carries out the rewinding operation, and determines the status as the "undetermined state", the control unit 221 changes the transition mode to Q1 along an arrow P8, thereby setting the tape position as the "starting end portion".

As described above, the temporary holding unit 215 is configured to update the tape position by transition to a new transition mode Q in the status transition diagram ST1 according to the last transition mode Q and the type of the operation (the winding operation or the rewinding operation).

The temporary holding unit 215 carries out the winding operation or the rewinding operation, while updating the tape position according to the status transition diagram ST1.

Figure 16:
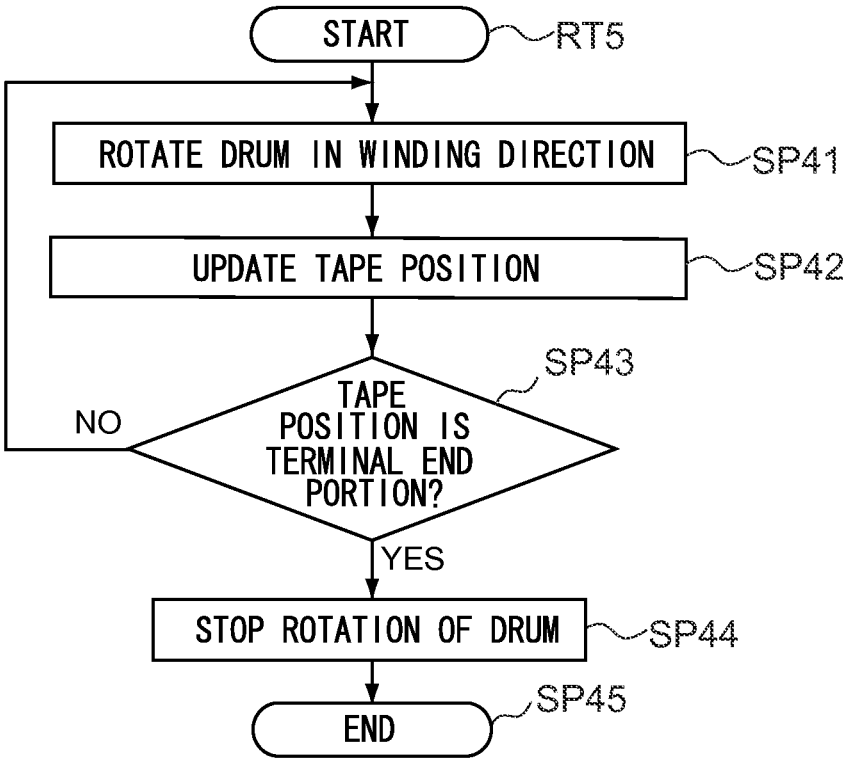
FIG. 16 is a flowchart illustrating a winding procedure according to the third embodiment.

For example, when accepting the instruction of holding the bill BL inside from the bill control unit 11 (FIG. 2) and so on in the status that the tape position is determined as the starting end portion or the middle portion, the control unit 221 starts the winding procedure RT5 illustrated in FIG. 16 corresponding to FIG. 5, and then, proceeds to step SP41.

In step SP41, the control unit 221 rotates the drum in the winding direction as in step SP1, and then, proceeds to next step SP42.

In step SP42, the control unit 221 changes the transition mode Q appropriately, according to the status transition diagram ST1, thereby updating the tape position, and then, proceeds to step SP43.

In step SP43, the control unit 221 determines whether the updated tape position is the terminal end portion or not. The case in which a negative result is obtained represents that the tape position is still the starting end portion or the middle portion, and it is not necessary to stop the rotation of the drum 23, since the tape position is the starting end portion even if the status is the "undetermined state". Therefore, the control unit 221 returns to step SP41 to continue the rotation of the drum 23.

The case in which a positive result is obtained in step SP43 represents that the tape position is determined to be the terminal end portion even if the obtained status is the "undetermined state". Therefore, the control unit 221 proceeds to step SP44.

In step SP44, the control unit 221 stops the rotation of the drum 23, and proceeds to step SP45 to end the winding procedure RT5.

Figure 6:
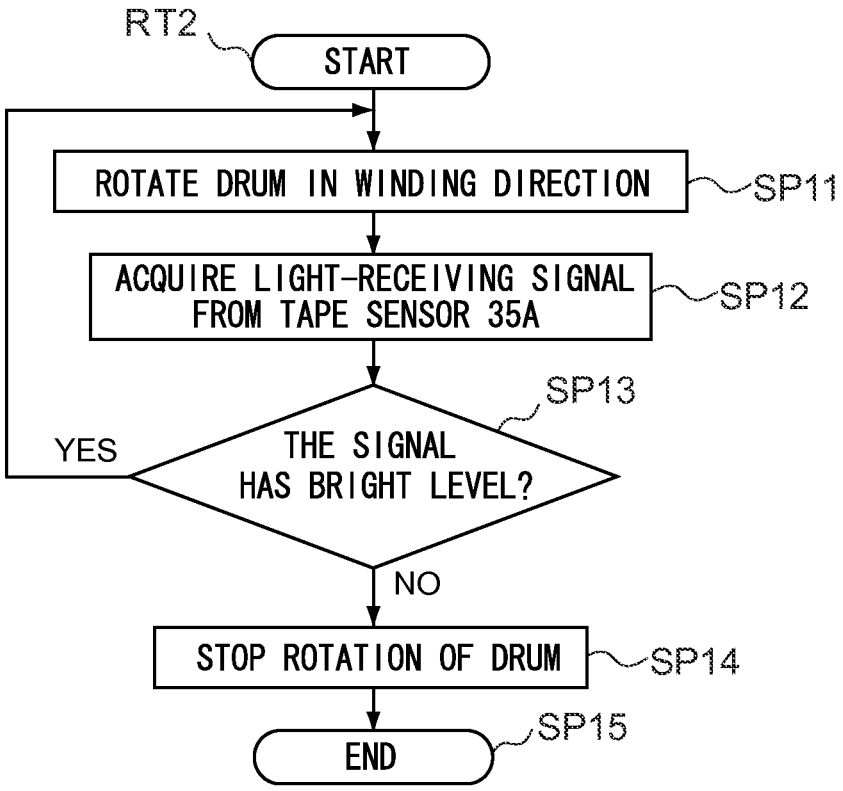
FIG. 6 is a flowchart illustrating a rewinding procedure according to the first embodiment.
Figure 17:
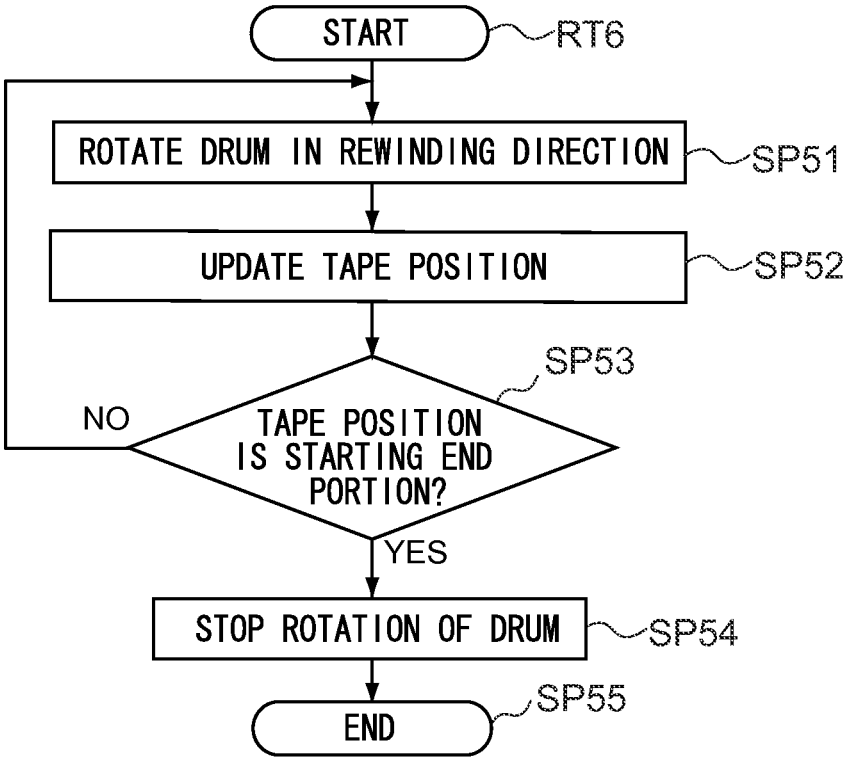
FIG. 17 is a flowchart illustrating a rewinding procedure according to the third embodiment.

When accepting the instruction of discharging the bill BL to the outside from the bill control unit 11 (FIG. 2) and so on in the status that the tape position is determined as the starting end portion or the middle portion, the control unit 221 starts the rewinding procedure RT6 illustrated in FIG. 17 corresponding to FIG. 6, and then, proceeds to step SP51.

In step SP51, the control unit 221 rotates the drum 23 in the rewinding direction as in step SP11, and then, proceeds to next step SP52.

In step SP52, the control unit 221 changes the transition mode Q appropriately, according to the status transition diagram ST1, thereby updating the tape position as in step SP42 , and then, proceeds to step SP53.

In step SP53, the control unit 221 determines whether the updated tape position is the starting end portion or not. The case in which a negative result is obtained represents that the tape position is still the terminal end portion or the middle portion, and it is not necessary to stop the rotation of the drum 23, since the tape position is the terminal end portion even if the status is the "undetermined state". Therefore, the control unit 221 returns to step SP51 to continue the rotation of the drum 23.

The case in which a positive result is obtained in step SP53 represents that the tape position is determined to be the starting end portion even if the obtained status is the "undetermined state". Therefore, the control unit 221 proceeds to step SP54.

In step SP54, the control unit 221 stops the rotation of the drum 23, and proceeds to step SP55 to end the rewinding procedure RT6.

As described above, the temporary holding unit 215 carries out the winding operation or the rewinding operation while updating the tape position according to the status transition diagram ST1, thereby being capable of correctly determining the tape position as the starting end portion or the terminal end portion even if the status is the "undetermined state".

[3-2. Operation and Effect]

In the configuration described above, in the temporary holding unit 215 according to the third embodiment, the light-shielding regions SA are formed on the starting end portion of the outer tape 130A and on the terminal end portions of the outer tapes 130A and 130B and the inner tapes 40A and 40B (FIG. 9), as same as in the second embodiment.

The temporary holding unit 215 generates light-receiving signals according to light transmittance of each tape by the tape sensors 35A, 135B, 45A, and 45B, and transmits these signals to the control unit 221.

The control unit 221 determines the status as any one of the "middle portion determined state", the "terminal end portion determined state", or the "undetermined state" according to the status table TBL1 (FIG. 13) based upon the light-receiving signals acquired from each tape sensor (35A, 135B, 45A, and 45B).

According to this configuration, the temporary holding unit 215 sets the status as the "undetermined state" in which the tape position is not specified, if only the tape sensor 35A detects the "dark" level and it cannot be determined whether the tape position is the starting end portion or the terminal end portion. Accordingly, the temporary holding unit 215 does not erroneously determine this tape position, thereby being capable of reliably eliminating a risk of damaging the tape.

Figure 18:
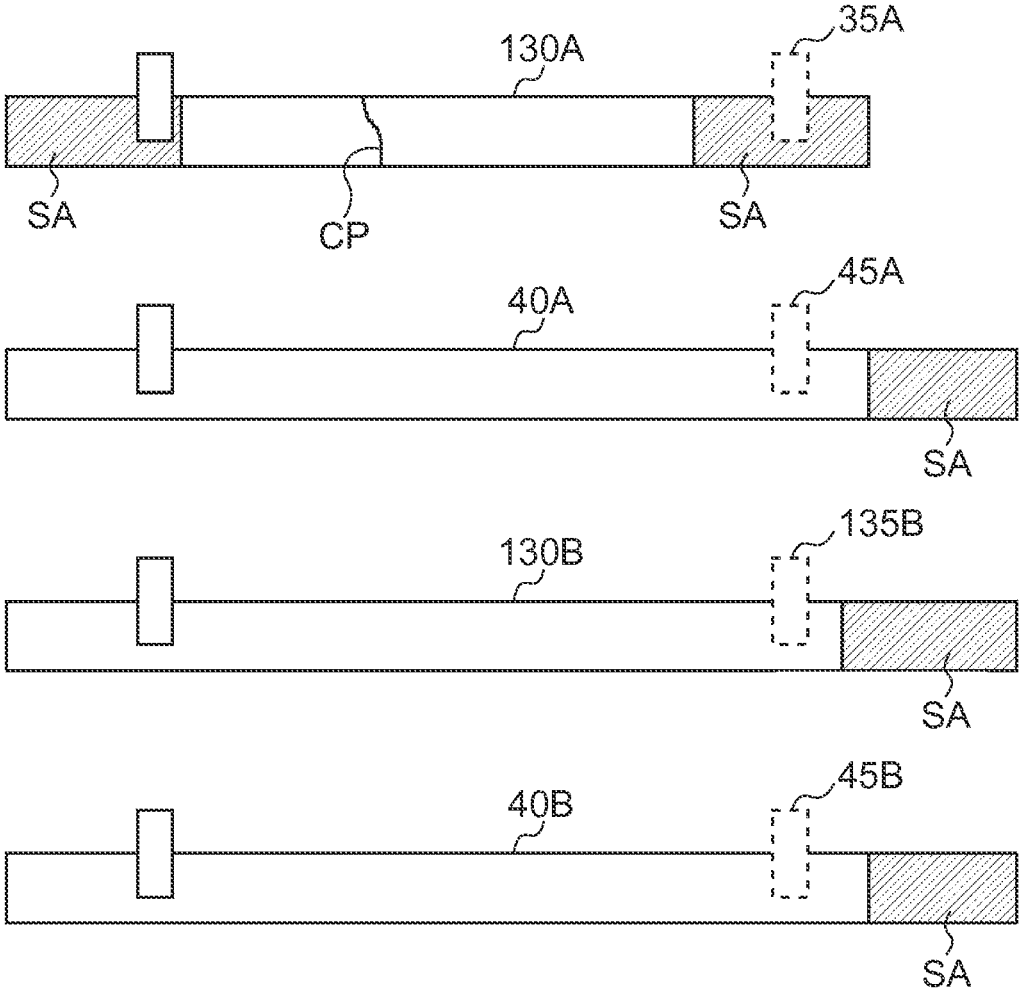
FIG. 18 is a schematic diagram for describing a detection of a light-shielding region by a tape sensor.
Figure 19A:
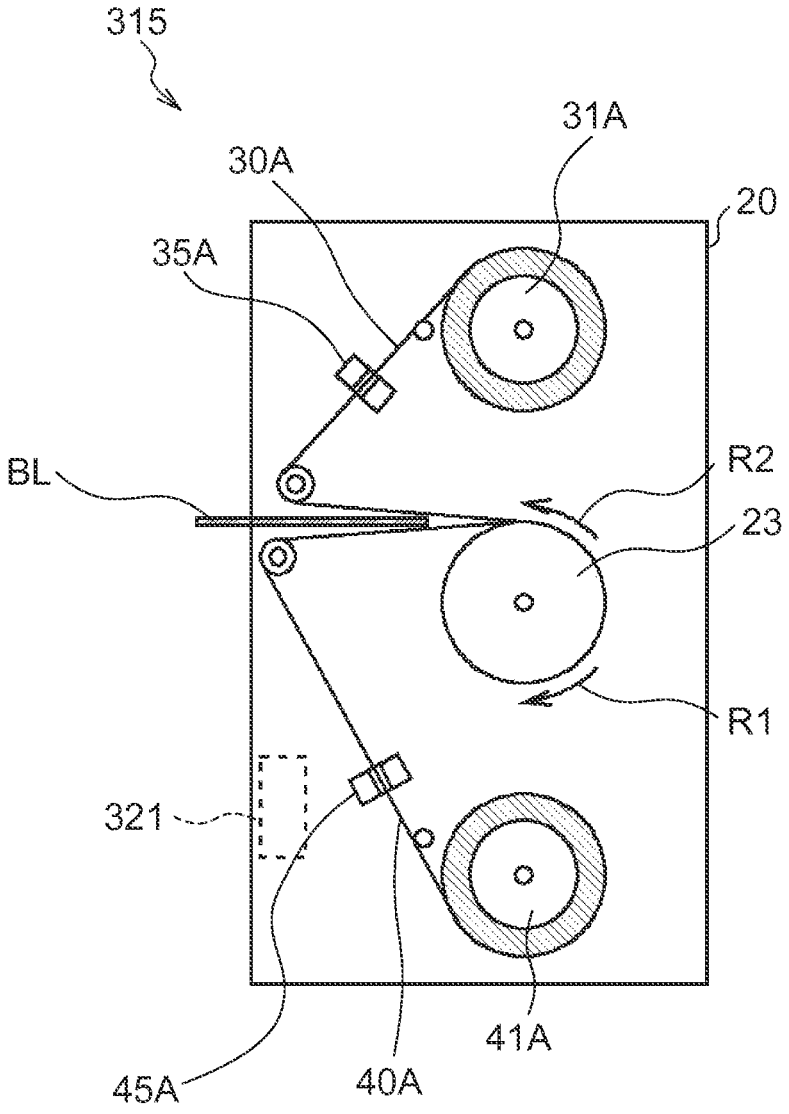
FIG. 19A is a right side view illustrating a configuration (1) of a conventional temporary holding unit.
Figure 19B:
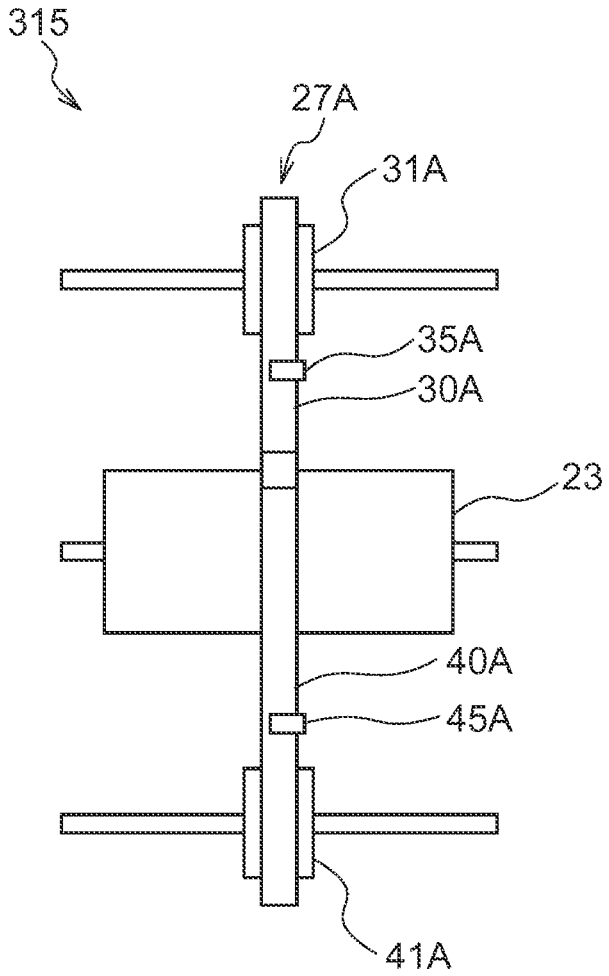
FIG. 19B is a back view illustrating the configuration (1) of the conventional temporary holding unit.
Figure 20:
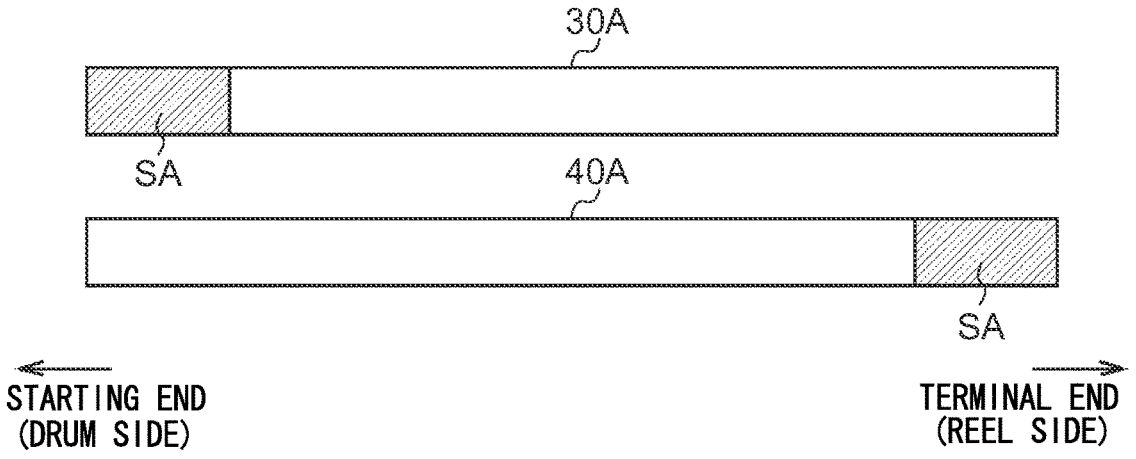
FIG. 20 is a schematic diagram illustrating a configuration (1) of a conventional tape.
Figure 21:
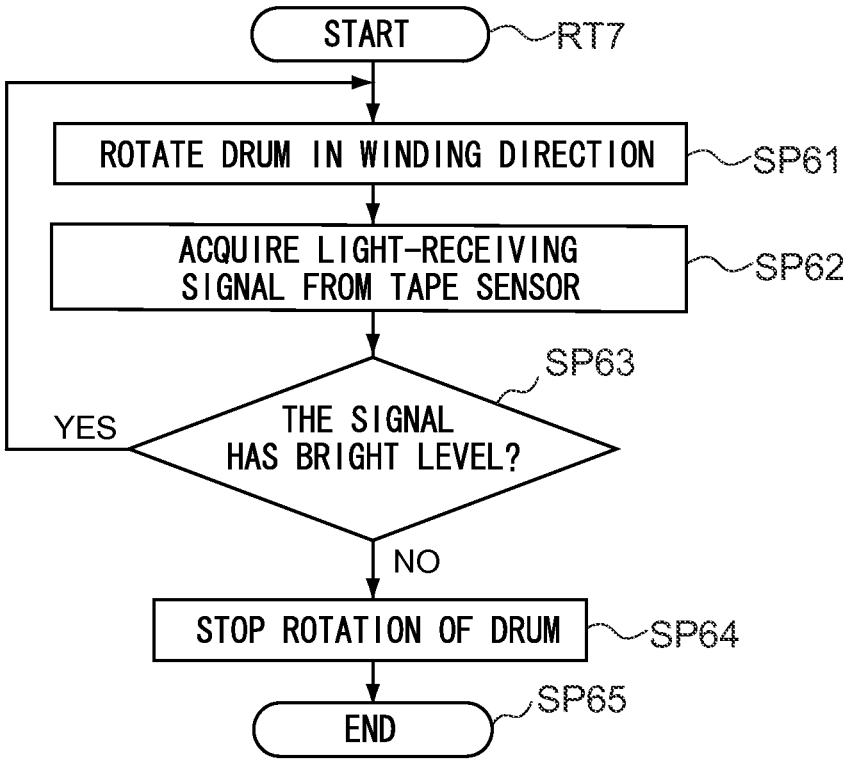
FIG. 21 is a flowchart illustrating a conventional winding procedure.

When the outer tape 130A is cut short during the maintenance operation and so on in the temporary holding unit 215, there is a possibility that the light-shielding region SA on only the outer tape 130A is detected for both the vicinity (indicated by a broken line) of the starting end portion (indicated by a solid line) and the vicinity of the terminal end portion, and hence, the tape sensor 35A detects the "dark" level, while the other tape sensors detect the "bright" level as illustrated in FIG. 18.

In view of this, the control unit 221 rotates the drum 23 in the winding direction with low speed, and monitors the change in the status and the rotation of the drum 23, when the last operating state cannot be specified just after the device is started. With this configuration, the control unit 221 can correctly determine the tape position as the middle portion or the terminal end portion.

In this case, the temporary holding unit 215 transmits relatively low driving force in order to rotate the drum 23 in the winding direction with low speed. Therefore, even if the tape reaches its terminal end portion, tensile force applied to the tape can be suppressed to be low. Accordingly, the risk of damaging the tape can significantly be reduced.

The control unit 221 also updates the tape position according to the status transition diagram ST1 (FIG. 15) after once determining the tape position. Therefore, even if the status becomes the "undetermined state", the control unit 221 can correctly specify the tape position as the terminal end portion or the starting end portion according to which one of the winding operation or the rewinding operation is last carried out.

Accordingly, the temporary holding unit 215 can employ the light-shielding regions SA that are formed respectively on the starting end portion and the terminal end portion of the outer tape 130A and have a common optical characteristic, and can detect these regions by the tape sensor 35A. Therefore, the temporary holding unit 215 can drastically simplify the configuration, compared to the case in which regions, each having a different optical characteristic, are formed on the starting end portion and the terminal end portion of the outer tape 130A, and two types of tape sensors are used.

In other words, since the optical characteristics of the light-shielding regions SA formed on the starting end portion and the terminal end portion of the outer tape 130A are common in the temporary holding unit 215, the tape position cannot correctly be determined only from the level of the light-receiving signal acquired from the tape sensor 35A, however, the temporary holding unit 215 can specify the tape position by considering the change in the status when the drum 23 rotates in the winding direction R1 or according to the last tape position and the operation.

If the temporary holding unit 215 executes the winding procedure RT3 (FIG. 10) and the rewinding procedure RT2 (FIG. 6), the temporary holding unit 215 stops the winding operation at the time when detecting the light-shielding region SA on only the outer tape 130A in the vicinity (indicated by a broken line in FIG. 18) of the terminal end portion during the winding operation. There is a possibility that even if the temporary holding unit 215 tries to start the rewinding operation, it detects the light-shielding region SA of the outer tape 130A, so that the rewinding operation is immediately stopped, and each tape cannot be rewound.

The temporary holding unit 215 actually updates the tape position according to the status transition diagram ST1 in light of the above situation. Therefore, even if the status becomes the "undetermined state" during the rewinding operation, the transition mode is not changed to the transition mode Q1 in which the tape position is the starting end portion unless the winding operation is carried out from the transition mode Q2 in which the tape position is the middle portion. Accordingly, the temporary holding unit 215 can correctly determine whether the tape position is the starting end portion or the terminal end portion based upon the last operation.

The temporary holding unit 215 can stop the rotation only when the tape position becomes the starting end portion by executing the rewinding procedure RT6 utilizing the update of the tape position according to the status transition diagram ST1. Accordingly, the temporary holding unit 215 can appropriately rewind the tape around the reel until the tape position becomes the starting end portion.

The temporary holding unit 215 can achieve the same operation and effect same as those of the temporary holding unit 115 according to the second embodiment in other aspects.

According to the configuration described above, in the temporary holding unit 215 according to the third embodiment, the tape sensors 35A, 135B, 45A, and 45B are provided, and the light-shielding regions SA are formed on the terminal end portions of the outer tapes 130A and 130B and the inner tapes 40A and 40B. The control unit 221 in the temporary holding unit 215 determines the status as the "middle portion determined state", the "terminal end portion determined state", or the "undetermined state" based upon the light-receiving signals from the tape sensors 35A, 135B, 45A and 45B. The temporary holding unit 215 determines the tape position, and then, updates the tape position according to the status transition diagram ST1 depending upon the operation just after the device is started. Accordingly, the temporary holding unit 215 can correctly determine the tape position, although the similar light-shielding regions SA are formed on the starting end portion and the terminal end portion of the outer tape 130A, whereby the temporary holding unit 215 can stop the drum 23 at the time when the tape reaches its terminal end portion during the winding operation or at the time when the tape reaches its starting end portion during the rewinding operation. Accordingly, the temporary holding unit 215 can prevent damage due to an application of excessive tensile force to each tape from occurring.

[4. Other Embodiment]

In the above first embodiment, the starting end portion is detected from the outer tape 30A, and the terminal end portion is detected from the inner tapes 40A and 40B.

However, the present invention is not limited thereto. For example, the starting end portion may be detected from the inner tape 40A, and the terminal end portion may be detected from the outer tapes 30A and 30B. The same applies to the second and third embodiments.

In the above second embodiment, the light-shielding region SA is formed on the starting end portion of only the outer tape 130A, i.e., only one tape.

However, the present invention is not limited thereto. For example, the light-shielding region SA may be formed on the starting end portions of two or more tapes, i.e., the light-shielding region SA may also be formed on the starting end portion of the outer tape 130B. It is only necessary that the light-shielding region SA is formed on the starting end portion of one or more tapes. However, it is desirable that the light-shielding region SA is not formed on the starting end portion of one or more tapes, in order to differentiate the starting end portion form the terminal end portion. The same applies to the third embodiment.

The above first and second embodiments describe the case in which the temporary holding unit determines whether the tape position becomes the terminal end portion or not during the winding operation, and the case in which the temporary holding unit determines whether the tape position becomes the starting end portion or not during the rewinding operation, based upon the light-receiving signal acquired from the tape sensor.

However, the present invention is not limited thereto. For example, if the temporary holding unit can detect whether the tape position is the starting end portion or not with another method, the temporary holding unit may only determine whether the tape position is the terminal end portion or not based upon the light-receiving signal acquired from the tape sensor.

In the above third embodiment, the light-shielding region SA is formed on the starting end portion of one tape (the outer tape 130A) and the terminal end portions of all tapes, the status is determined as any one of the "middle portion determined state", the "terminal end portion determined state", or the "undetermined state", and if the status is the "undetermined state", the tape position is determined based upon the last operating state or the status change while rotating the drum 23 with low speed.

However, the present invention is not limited thereto. The light-shielding region SA may be formed on the starting end portion of any number of tapes and the terminal end portion of any number of tapes. In this case, the light-shielding region SA on the starting end portion and the light-shielding region SA on the terminal end portion may be distinguished by making the combination of tapes having the light-shielding region SA on the starting end portion and the combination of tapes having the light-shielding region SA on the terminal end portion different. In this case, the status may be determined by using a status table according to these combinations, and the status may be changed to update the tape position according to the status transition diagram according to these combinations.

In this case, the status is not limited to the combination of the "middle portion determined state", the "terminal end portion determined state", and the "undetermined state". For example, the status may be the combination of the "middle portion determined state", the "undetermined state", and a "starting end portion determined state" in which the starting end portion of the tape is determined In the above third embodiment, if the status is the undetermined state and the last operation is unclear, the drum 23 is rotated in the winding direction with low speed.

However, the present invention is not limited thereto. For example, the drum 23 may be rotated in the rewinding direction R2 with low speed, as well as each reel may be rotated in the direction of winding each tape.

In the above first embodiment, the tape sensors 35A, 45A, and 45B generate light-receiving signals according to light transmittance of each tape at a tape position, and transmit these signals to the control unit 21, and the control unit 21 determines whether the signals have the "bright" level or the "dark" level.

However, the present invention is not limited thereto. For example, the tape sensors 35A, 45A, and 45B may detect light transmittance of each tape at a tape position, compare the light transmittance to a predetermined threshold value for determining that the signals have the "bright" level or the "dark" level, and may transmit the determination result to the control unit 21. The same applies to the second and third embodiments.

In the above first embodiment, the rotation of the drum 23 is detected by the sensor provided at the drum 23.

However, the present invention is not limited thereto. For example, a sensor may be provided at a motor (not illustrated) that supplies driving force to the drum 23, a gear and/or a belt (not illustrated) that transmits driving force between the motor and the drum 23, in order to detect the rotation of the drum 23. The same applies to the second and third embodiments.

In the above first embodiment, the two sytems of the tape running systems 27 are provided at the temporary holding unit 15.

However, the present invention is not limited thereto. Three or more systems of the tape running systems 27 may be provided at the temporary holding unit 15 in order to stabilize the winding of the bill BL around the drum 23. In this case, the light-shielding region SA may be formed on the terminal end portion of the inner tape 40 in each tape running system, and the tape sensor 45 may be provided. The same applies to the second and third embodiments.

In the above first embodiment, each tape is entirely made of a transparent material for allowing the detection light to pass through each tape, while the light-shielding region SA that shields the detection light is formed on some of the starting end portions and the terminal end portions, and the light transmittance of the detection light is detected by each tape sensor.

However, the present invention is not limited thereto. For example, a reflection region that reflects the detection light may be formed on the starting end portion or the terminal end portion of each tape, and the reflection light of the detection light may be received by the tape sensor. Alternatively, each tape may be made of a material having light shielding property, and a light-transmitting region that transmits light may be formed, as appropriate, on the starting end portion and the terminal end portion.

Alternatively, each tape may entirely be made of a non-magnetic member, and a magnetized region may be formed on some of the starting end portions and the terminal end portions, and whether or not the magnetism is present may be detected by a magnetic sensor. Specifically, the present invention may be configured such that a region having a physical property different from the physical property of the entire tape is formed on some of the starting end portions and the terminal end portions of the respective tapes, and the difference in the physical property is detected by a predetermined sensor. The same applies to the second and third embodiments.

In the above first embodiment, a bill BL serving as a medium is held in the temporary holding unit 15 in the automated teller machine 1 that makes transaction for cash with a customer in a financial institution.

However, the present invention is not limited thereto. For example, the present invention may be applied to a temporary holding unit incorporated into a cashier system used by an office staff who makes various processing for cash in a financial institution, or the present invention may be applied to various devices that hold a sheet-shaped medium such as a gift certificate, a cash voucher, or an admission ticket. The same applies to the second and third embodiments.

In the above first embodiment, the temporary holding unit 15 serving as a medium processing device is configured by using the drum 23 as a drum, the inner tapes 40A and 40B as an inner tape, the outer tapes 30A and 30B as an outer tape, a light-shielding region SA as a differing region, tape sensors 35A, 45A, and 45B as a tape sensor, and the control unit 21 as a control unit.

However, the present invention is not limited thereto. The medium processing device may be configured by using various other configurations including a drum, an inner tape, an outer tape, a differing region, a detecting unit, and a control unit.

INDUSTRIAL APPLICABILITY

The present invention can be utilized for various devices that wind a sheet-like medium such as a bill around a drum together with a tape, and temporarily hold this medium.

The invention claimed is:

1. A medium processing device, comprising:

a cylindrical drum that rotates about a center axis;

an inner reel structure;

an outer reel structure;

a first inner tape that is drawn from the inner reel structure, and is wound around a peripheral side face of the drum at a first location;

the first inner tape includes a first starting end portion at a drum side, a first terminal end portion at an inner reel structure side, and a first middle portion that is neither the first starting end portion nor the first terminal end portion;

a second inner tape that is drawn from the inner reel structure, and is wound around the peripheral side face of the drum at a second location that is different than the first location;

the second inner tape includes a second starting end portion at a drum side, a second terminal end portion at an inner reel structure side, and a second middle portion that is neither the second starting end portion nor the second terminal end portion;

a first outer tape that is drawn from the outer reel structure, and is wound around the peripheral side face of the drum together with the first inner tape and a sheet-shaped medium, with the medium being sandwiched between the first inner tape and the first outer tape;

the first outer tape includes a third starting end portion at a drum side, a third terminal end portion at an outer reel structure side, and a third middle portion that is neither the third starting end portion nor the third terminal end portion;

a second outer tape that is drawn from the outer reel structure, and is wound around the peripheral side face of the drum together with the second inner tape and the medium, with the medium being sandwiched between the second inner tape and the second outer tape;

the second outer tape includes a fourth starting end portion at a drum side, a fourth terminal end portion at an outer reel structure side, and a fourth middle portion that is neither the fourth starting end portion nor the fourth terminal end portion;

a detecting structure that detects a prescribed physical property; and a control unit that controls a rotation of the drum based upon a detection result of the detecting structure, wherein at least one of the first starting end portion, the second starting end portion, the third starting end portion or the fourth starting end portion has the prescribed physical property, wherein at least one of both the first terminal end portion and the second terminal end portion, or both the third terminal end portion and the fourth terminal end portion, have the prescribed physical property, wherein none of the first middle portion, the second middle portion, the third middle portion and the fourth middle portion have the prescribed physical property, wherein the first terminal end portion, the second terminal end portion, the third terminal end portion and the fourth terminal end portion have the prescribed physical property, wherein the third starting end portion has the prescribed physical property, the first starting end portion, the second starting end portion and the fourth starting end portion do not have the prescribed physical property, wherein the control unit classifies a detection state of the first inner tape, the second inner tape, the first outer tape and the second outer tape, as a middle portion determined state in which the detecting structure does not detect the prescribed physical property on any of the first inner tape, the second inner tape, the first outer tape and the second outer tape, a terminal end portion determined state in which the detecting structure detects the prescribed physical property on at least one of the first inner tape, the second inner tape and the fourth outer tape, and an undetermined state in which the detecting structure detects the prescribed physical property on only the first outer tape, and recognizes a tape position based upon the detection state, and wherein the control unit records whether a last rotating direction of the drum is a winding direction for winding the first inner tape, the second inner tape, the first outer tape and the second outer tape, or a rewinding direction reverse to the winding direction, and if the detection state is the undetermined state, the control unit recognizes the tape position according to the last rotating direction of the drum which is recorded.

2. The medium processing device according to claim 1, wherein the control unit, recognizes, based on the detection result of the detecting structure, whether a first tape position of the first inner tape at the detecting structure is the first starting end portion, the first terminal end portion or the first middle portion, whether a second tape position of the second inner tape at the detecting structure is the second starting end portion, the second terminal end portion or the second middle portion, whether a third tape position of the first outer tape at the detecting structure is the third starting end portion, the third terminal end portion or the third middle portion, whether a fourth tape position of the second outer tape at the detecting structure is the fourth starting end portion, the fourth terminal end portion or the fourth middle portion, and controls the rotation of the drum based upon the first tape position, the second tape position, the third tape position and the fourth tape position.

3. The medium processing device according to claim 1, wherein the first inner tape, the second inner tape, the first outer tape and the second outer tape are made of a transmissive material that transmits a predetermined detection light, the prescribed physical property shields the detection light, and the detecting structure detects a ratio of the detection light transmitted through the first inner tape, the second inner tape, the first outer tape or the second outer tape at a tape position at the detecting structure.

4. The medium processing device according to claim 1, wherein the detecting structure detects the prescribed physical property to control rotation of the drum or to determine a tape position of the first inner tape, the second inner tape, the first outer tape and the second outer tape.

5. The medium processing device according to claim 1, wherein an area of the first middle portion is larger than an area of the first starting end portion and an area of the first terminal end portion, an area of the second middle portion is larger than an area of the second starting end portion and an area of the second terminal end portion, an area of the third middle portion is larger than an area of the third starting end portion and an area of the third terminal end portion, and an area of the fourth middle portion is larger than an area of the fourth starting end portion and an area of the fourth terminal end portion.

6. A medium processing device, comprising:

a cylindrical drum that rotates about a center axis;

an inner reel structure;

an outer reel structure;

a first inner tape that is drawn from the inner reel structure, and is wound around a peripheral side face of the drum at a first location;

the first inner tape includes a first starting end portion at a drum side, a first terminal end portion at an inner reel structure side, and a first middle portion that is neither the first starting end portion nor the first terminal end portion;

a second inner tape that is drawn from the inner reel structure, and is wound around the peripheral side face of the drum at a second location that is different than the first location;

the second inner tape includes a second starting end portion at a drum side, a second terminal end portion at an inner reel structure side, and a second middle portion that is neither the second starting end portion nor the second terminal end portion;

a first outer tape that is drawn from the outer reel structure, and is wound around the peripheral side face of the drum together with the first inner tape and a sheet-shaped medium, with the medium being sandwiched between the first inner tape and the first outer tape;

the first outer tape includes a third starting end portion at a drum side, a third terminal end portion at an outer reel structure side, and a third middle portion that is neither the third starting end portion nor the third terminal end portion;

a second outer tape that is drawn from the outer reel structure, and is wound around the peripheral side face of the drum together with the second inner tape and the medium, with the medium being sandwiched between the second inner tape and the second outer tape;

the second outer tape includes a fourth starting end portion at a drum side, a fourth terminal end portion at an outer reel structure side, and a fourth middle portion that is neither the fourth starting end portion nor the fourth terminal end portion;

a detecting structure that detects a prescribed physical property; and a control unit that controls a rotation of the drum based upon a detection result of the detecting structure, wherein at least one of the first starting end portion, the second starting end portion, the third starting end portion or the fourth starting end portion has the prescribed physical property, wherein at least one of both the first terminal end portion and the second terminal end portion, or both the third terminal end portion and the fourth terminal end portion, have the prescribed physical property, wherein none of the first middle portion, the second middle portion, the third middle portion and the fourth middle portion have the prescribed physical property, wherein the first terminal end portion, the second terminal end portion, the third terminal end portion and the fourth terminal end portion have the prescribed physical property, wherein the third starting end portion has the prescribed physical property, the first starting end portion, the second starting end portion and the fourth starting end portion do not have the prescribed physical property, wherein the control unit classifies a detection state of the first inner tape, the second inner tape, the first outer tape and the second outer tape, as a middle portion determined state in which the detecting structure does not detect the prescribed physical property on any of the first inner tape, the second inner tape, the first outer tape and the second outer tape, a terminal end portion determined state in which the detecting structure detects the prescribed physical property on at least one of the first inner tape, the second inner tape and the fourth outer tape, and an undetermined state in which the detecting structure detects the prescribed physical property on only the first outer tape, and recognizes a tape position based upon the detection state, and wherein the control unit rotates the drum with low speed, and recognizes the tape position based upon the detection state which is acquired after the control unit rotates the drum with low speed, if the detection state is the undetermined state and the last rotating direction cannot be determined.

7. The medium processing device according to claim 6, further comprising a drum rotation detecting unit that detects a rotating state of the drum, wherein the control unit recognizes the tape position as the terminal end portion or the starting end portion, if the drum rotation detecting unit detects that the drum does not rotate, when the control unit tries to rotate the drum in the winding direction or in the rewinding direction with low speed.

* * * * *